US007946928B2

(12) United States Patent
Mooney

(10) Patent No.: US 7,946,928 B2
(45) Date of Patent: May 24, 2011

(54) MEASUREMENT AND ANALYSIS OF FOOT RELATED FORCES DURING A GOLF SWING

(76) Inventor: Brian Francis Mooney, Dun Laoghaire (IE)

( * ) Notice: Subject to any disclaimer, the term of this patent is extended or adjusted under 35 U.S.C. 154(b) by 406 days.

(21) Appl. No.: 11/913,297

(22) PCT Filed: May 8, 2005

(86) PCT No.: PCT/IE2006/000051

§ 371 (c)(1),
(2), (4) Date: Jun. 27, 2008

(87) PCT Pub. No.: WO2006/120658

PCT Pub. Date: Nov. 16, 2006

(65) Prior Publication Data

US 2008/0318703 A1 Dec. 25, 2008

(30) Foreign Application Priority Data

May 6, 2005 (IE) ..... S2005/0288

(51) Int. Cl.
*A63B 69/36* (2006.01)
*A63B 69/00* (2006.01)

(52) U.S. Cl. ..... 473/269; 473/266

(58) Field of Classification Search ..... 473/269, 473/270, 278, 409, 266; 434/247, 248, 249, 434/269

See application file for complete search history.

(56) References Cited

U.S. PATENT DOCUMENTS

| | | | | |
|---|---|---|---|---|
| 4,633,721 | A | 1/1987 | Nishiyama et al. | |
| 5,118,112 | A * | 6/1992 | Bregman et al. | 473/269 |
| 5,150,902 | A * | 9/1992 | Heisler | 473/269 |
| 5,697,791 | A * | 12/1997 | Nashner et al. | 434/247 |
| 6,039,658 | A | 3/2000 | Cecchin et al. | |
| 6,402,635 | B1 | 6/2002 | Nesbit et al. | |

* cited by examiner

*Primary Examiner* — Nini Legesse

(57) ABSTRACT

Apparatus (1) comprises a standing surface (2) for the player; a communication means (27); and a plurality of sensors (11) which are operable to measure force. The standing surface (2) comprises two separate foot platforms (3, 4) for the player's feet. Each foot platform (3, 4) comprises a supporting structure or supporting members where vertical forces are distributed to a plurality of discrete positions (5). The sensors (11) are located at the discrete positions (5) to which the vertical forces are distributed. The sensors (11) are operable to measure vertical forces. The apparatus also comprises a computing means (26) which is operable to analyze the swing, and includes means to receive and separately process signals from individual or groups of sensors (11); means to determine the relative magnitudes and positions of resultant forces by balance-resolution of forces, including individual forces, measured by the sensors (11) in relation to the discrete positions of the sensors (11); and means to analyze and evaluate numerical data related to the measured positions and magnitudes of the forces.

60 Claims, 12 Drawing Sheets

MEASUREMENT AND ANALYSIS OF FOOT RELATED FORCES DURING A GOLF SWING

The present invention relates to a method and apparatus for measuring and analysing foot related forces during a golf swing or a sports swing which is similar to a golf swing It is widely accepted that the characteristics of a golfer's weight shift during a golf swing bear an important relationship to the accuracy and power of the swing. However, despite its known importance, it has been found difficult to make use of weight shift during instruction or practice because neither a golfer nor observer can properly sense the characteristics of weight shift during the rapid golf swing. In addition, the relationship is usually misunderstood, and proper procedures related to weight shift have traditionally been learned more by trial and error methods than by instruction.

The prior art has produced various devices which claim to measure and analyse characteristics of the golf swing through measurement of forces exerted by the feet of the player. However, none of these devices appears to be of any real benefit or assistance to the ordinary golfer.

U.S. Pat. Nos. 5,150,902 and 5,118,112 disclose devices where the standing surface comprises two small moveable force sensitive pads on which the feet are positioned. Such pads prevent measurement or analysis of natural foot positions and present an unrealistic and distracting condition for the player. Neither specification discloses force sensors which are practical or capable of accurately measuring relevant force components. Neither specification discloses methods or means by which the swing is analysed or communicated to an ordinary player in a useful or useable format.

U.S. Pat. Nos. 5,697,791 and 6,225,977 disclose devices where the standing surface comprises a single platform, and which comprises specific markings on which the player stands. Similar to the pads, specific markings prevent measurement or analysis of natural foot positions and present an unrealistic and distracting condition for the player. The specifications indicate that the analysis is limited to tracking a player's overall centre of gravity, which is inadequate for proper analysis of the swing. Neither specification discloses methods or means by which results are communicated to an ordinary player in a useful or useable format.

In addition to the above, the prior art is known to have produced various arrangements which were necessarily operated by technicians or experts, where foot related forces in golf swings were measured by force plate or pressure pad devices, sometimes in conjunction with video analysis devices. The results were typically communicated as visual graphs showing force changes, and required subjective interpretation by technicians or experts. The arrangements were expensive and produced results which were not practicably useful to, or usable by, the ordinary golfer.

The present invention overcomes these various deficiencies of the prior art and provides a method and apparatus which appropriately measures and analyses foot related forces during a golf swing in a manner where results are communicated to an ordinary golfer in a useful and useable format. The present invention also provides an apparatus which can be produced at low cost and is suitable for operation by an ordinary golfer with or without assistance from a skilled third party.

An aspect of the present invention relates to an appreciation that the complex foot forces which result from a player's movement can be effectively analysed from measurement and analysis of the resultant vertical forces exerted by the player as a whole and by the player's individual left and right feet. Simplification of the complex movement to these resultant forces advantageously permits measurement and analysis to be effectively carried out.

A further aspect of the invention relates to an appreciation that the relative positions and movements of the resultant vertical forces are of importance, in particular the positions and movements relative to the positions of the feet.

An additional aspect of the invention relates to an appreciation that the position of a resultant force can be determined by supporting the forces, which give rise to the resultant force, on a structural supporting surface; distributing the supported forces to force sensors at discrete positions supporting the surface; and the application of a balance-resolution of the forces measured by force sensors at the discrete positions to determine the magnitude and position of the resultant force.

Throughout the description, the execution or application of 'balance-resolution' of forces refers to the execution or application of one or more of any of the following well-known and closely-related principles, or to principles which have equivalent effect:—

The sum of any balanced set of forces is zero; The sum of any balanced set of forces projected onto a common plane is also zero; The sum of the moments of any balanced set of forces is also zero, where the moments are taken about a common point; The sum of the projected moments of any balanced set of forces are also zero, where the moments are projected onto a common plane, and where the moments are taken about a common point or a common line perpendicular to the common plane.

These expressions are relevant to the apparatus in that foot forces are balanced by the supporting forces at the sensors and are also balanced by their component forces. Generally, the relevant foot forces, supporting forces and component forces are vertical forces and the common planes are vertical planes.

Prior art devices have tended to rely on standing pads, or marked areas on standing surfaces, which defined the positions of the player's feet.

A further aspect of the invention relates to an appreciation that foot related forces are preferably measured during a golf swing with the player's feet disposed in a natural position, as would occur in normal play or practice, ideally with the player selecting his or her position with minimal limitation or suggestion of foot positions. This has several advantages, including the following. It allows the player to better replicate normal play or practice. It avoids the distraction of abnormal foot positions or markings. It allows the player to duplicate the same errors which he or she makes in real play and allows the device to analyse and assist in the correction of those errors. It allows the player to experiment with different stances.

In a preferred embodiment of the present invention, the player stands on a standing surface which is sufficiently large to accommodate the normal range of possible stance positions. In a further refinement of this aspect of the invention, the method and apparatus are operable to calculate or determine the player's chosen foot positions on the standing surface. This provides several important further advantages. First, knowledge of the position of the foot position allows the resultant forces on the foot to be more accurately analysed. Second, it allows the apparatus to assess the player's chosen foot positions by comparing them to general accepted correct positions. Third, it allows the apparatus to detect changes in foot position during the swing.

Throughout this description, a method and apparatus are described for a player who strikes the ball in a direction from right to left, which is typical for a right handed player executing a golf swing. A mirror image arrangement applies to a method and apparatus for a player who strikes the ball from left to right. In some parts of the description and claims, the foot closest to the target, or direction in which the ball is being hit, may be referred to as the 'front foot' and the other foot may be referred to as the 'back foot'.

The invention will now be described more particularly with reference to the accompanying figures which show an apparatus suitable for measuring and analysing foot related forces during a golf swing.

FIG. 1 shows a schematic plan view of an apparatus which includes a standing surface and a playing mat. The standing surface comprises a left foot platform and a right foot platform. Each foot platform is supported from underneath at four corner positions. The locations of these support positions are indicated on the figure, although they are not actually visible in plan view. The figure also shows the outlines of the player's feet in typical positions. The figure additionally shows a ball, with the ball, playing mat and standing surface disposed in relative positions suitable for shots with a long club, such as a driver club.

FIG. 2 shows a view of the left foot platform, similar to that shown in FIG. 1, but on a larger scale. The view shows the centre positions of sensor means located at the four corner positions. The view also shows the resultant force, L, exerted by the foot on the platform, together with its lateral and longitudinal distance from the sensor means centres.

Throughout the description, the terms 'longitudinal' and 'longitudinally' shall refer to the front-to-back horizontal direction, and the terms 'lateral' and 'laterally' shall refer to the side-to-side horizontal direction at 90° to the longitudinal direction.

FIG. 3 shows a view of the standing surface and outlines of feet, similar to that shown in FIG. 1. The view also shows the resultant forces, L and R, exerted by the left foot and right foot on the left and right platforms, respectively, and the overall resultant force W exerted by the player. The view also shows the longitudinal distance between the forces and the centre positions of sensor means, and the relative lateral distances between the forces. The upper part of the view additionally shows the lateral distances between the overall resultant force and the centres of the platforms.

Figure 7A:
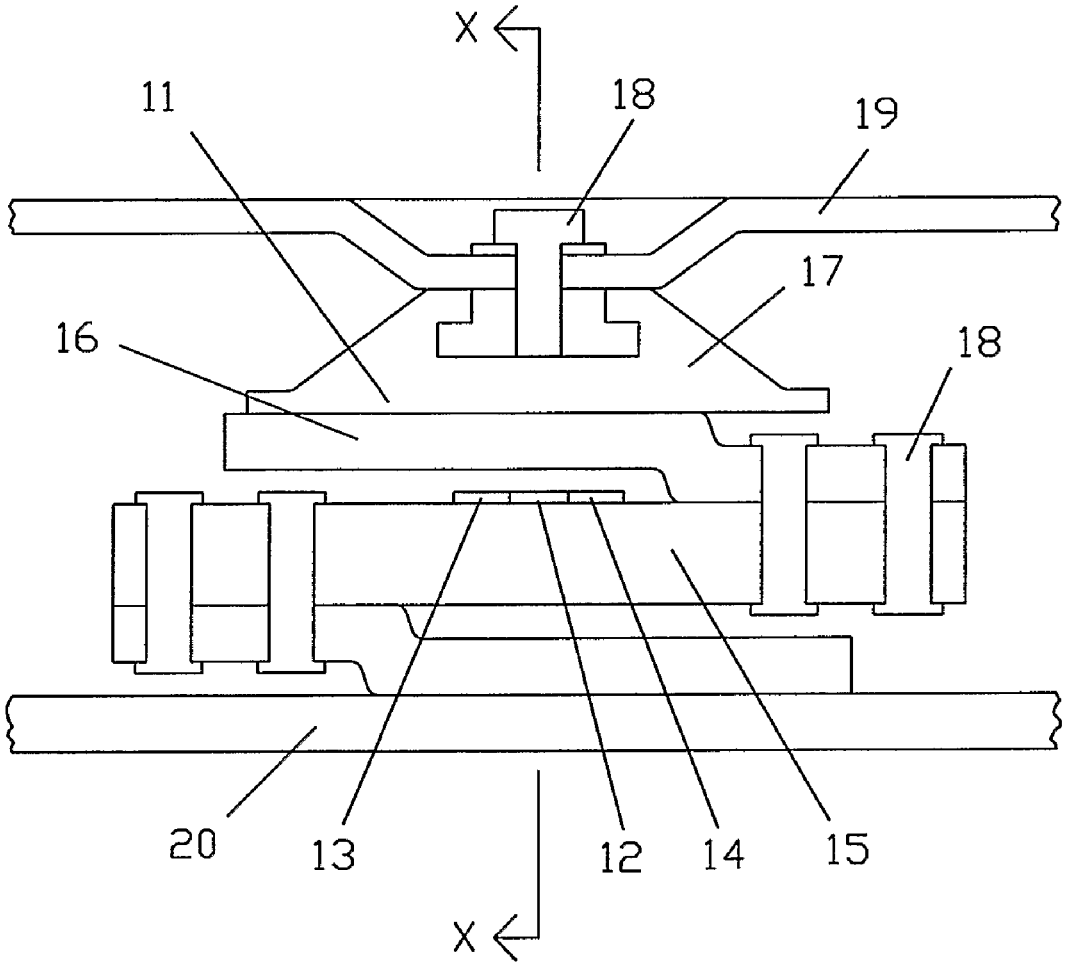
Figure 7B:
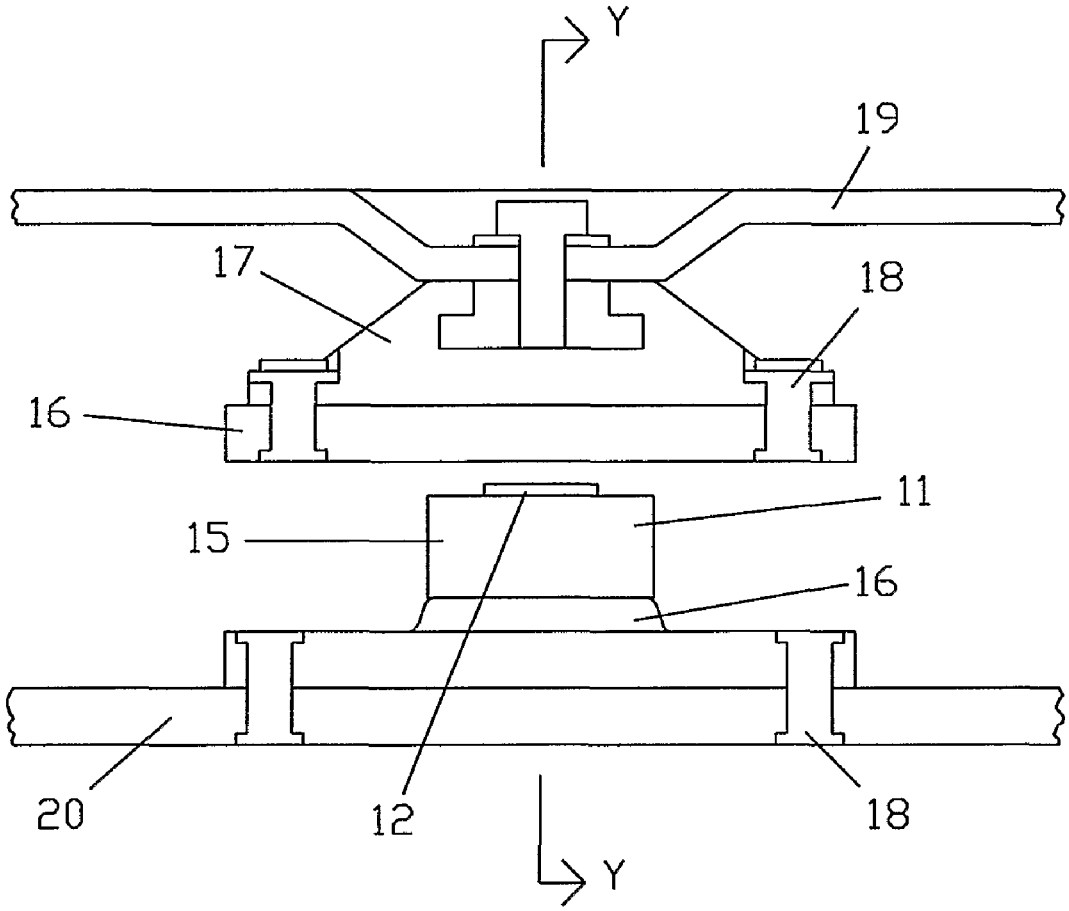

FIG. 7*a* shows a side cross sectional view, through Y-Y of FIG. 7*b*, of a sensor means which is operable to measure the vertical force applied to it.

FIG. 7*b* shows a side cross sectional view, through X-X of FIG. 7*a*, of the sensor means which is shown in FIG. 7*a*.

Figure 8A:
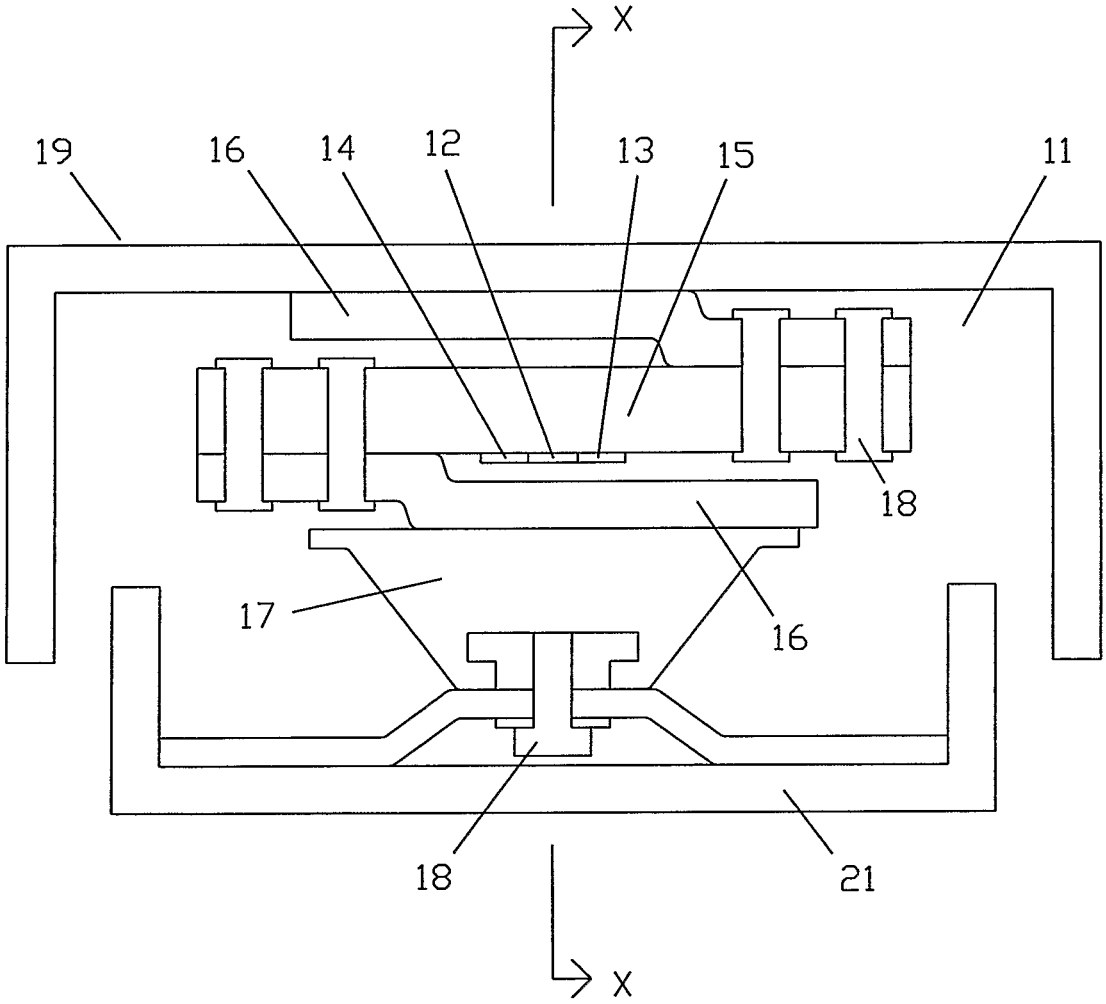
Figure 8B:
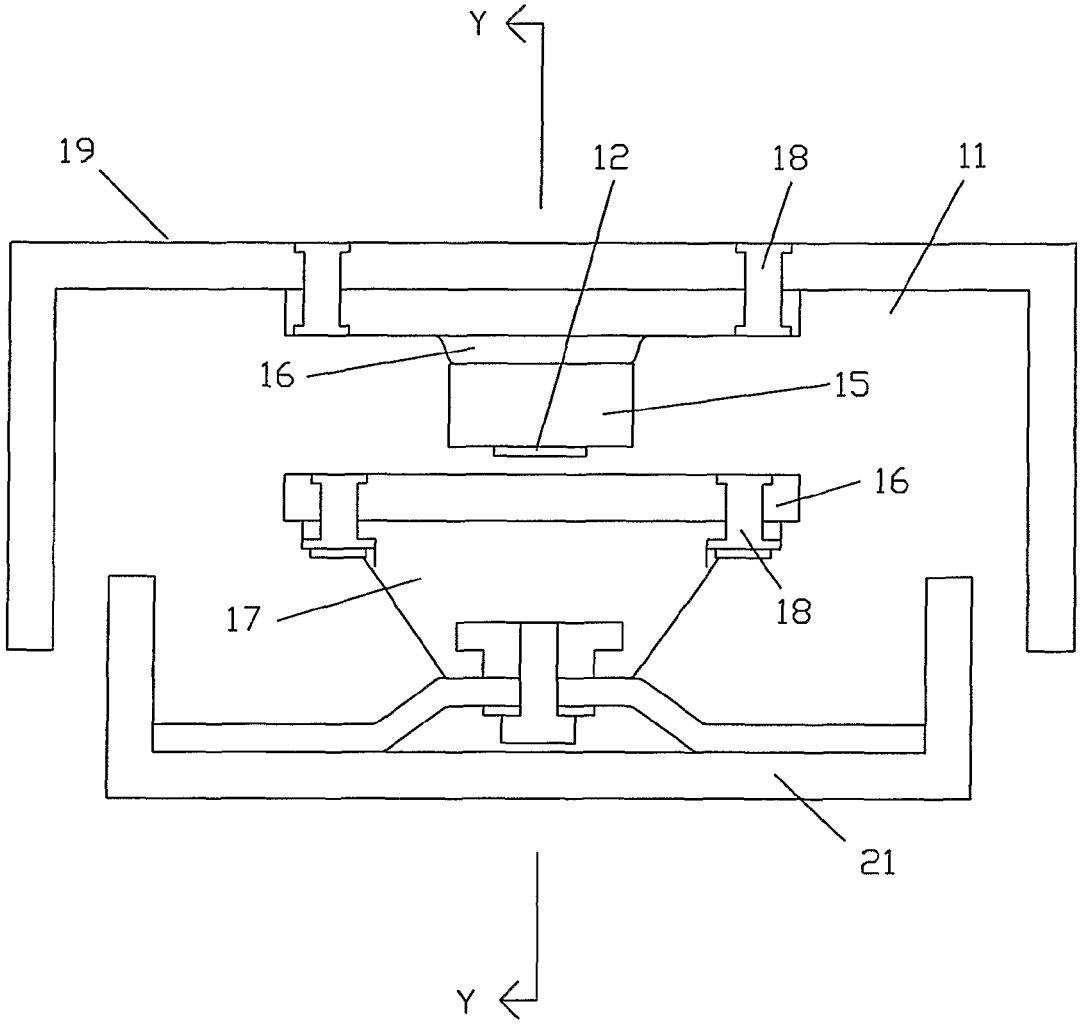

FIG. 8*a* shows a side cross sectional view, through Y-Y of FIG. 8*b*, of an alternative sensor means which is operable to measure the vertical force applied to it.

FIG. 8*b* shows a side cross sectional view, through X-X of FIG. 8*a*, of the alternative sensor means which is shown in FIG. 8*a*.

Figure 9A:
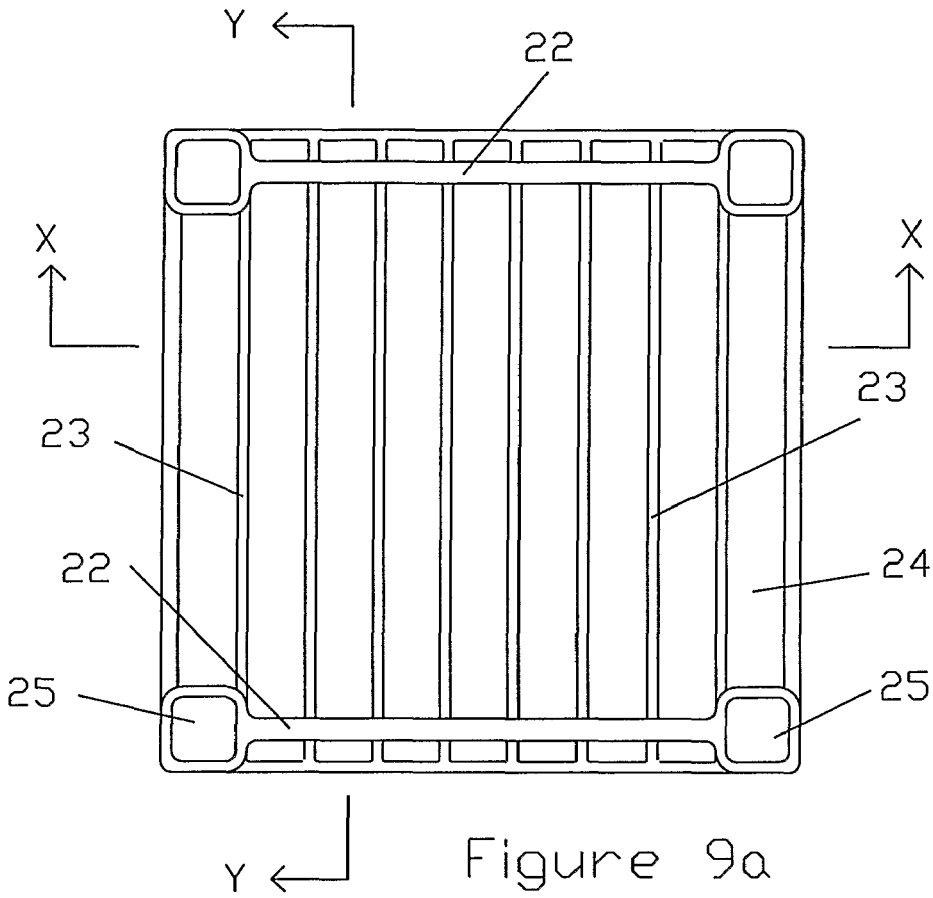

FIG. 9*a* shows an underneath view of a foot platform with biased rigidity.

Figure 9B:
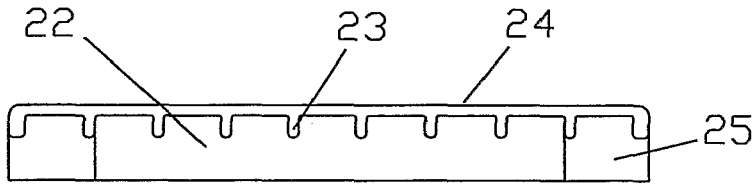

FIG. 9*b* shows a side sectional view, on X-X of FIG. 9*a*, of the foot platform shown in FIG. 9*a*.

Figure 9C:
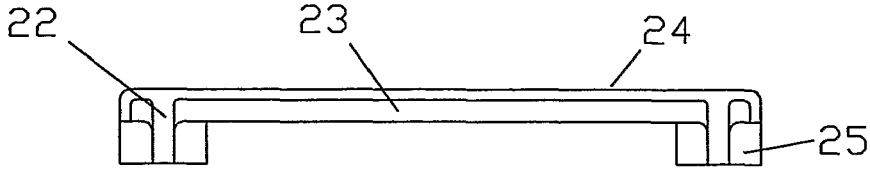

FIG. 9*c* shows a side sectional view, on Y-Y of FIG. 9*a*, of the foot platform shown in FIG. 9*a*.

Figure 10:
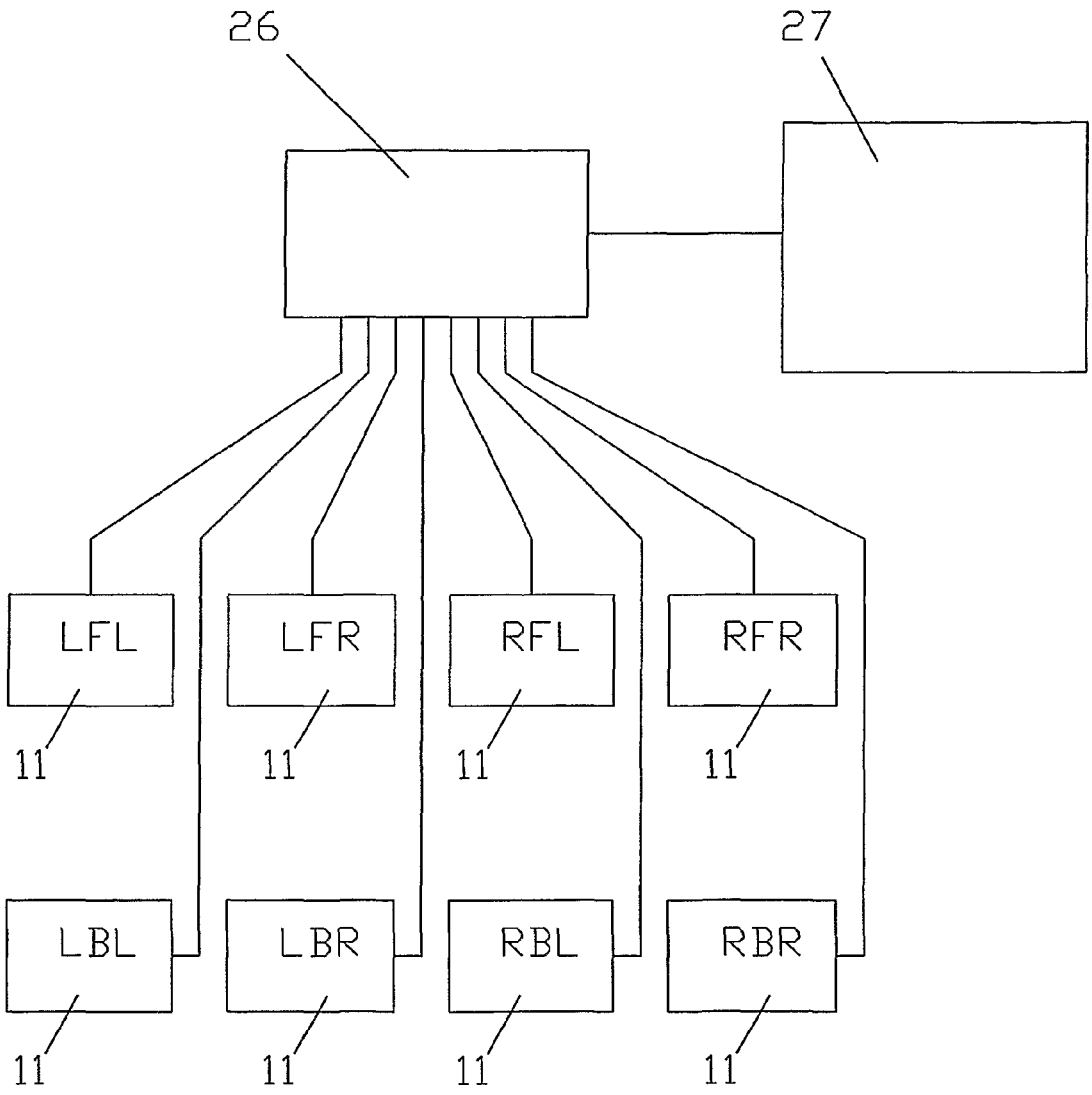

FIG. 10 is a block diagram showing the connection links between the sensor means, the computing means and the communication means.

The following is an index of the reference numerals used in the figures:

1. Apparatus.
2. Standing surface.
3. Left foot platform.
4. Right foot platform.
5. Sensor position.
6. Outline of left foot.
7. Outline of right foot.
8. Playing mat.
9. Ball.
10. Location for spacer member.
11. Sensing means/Vertical force sensor.
12. Strain gauge assembly.
13. Strain gauge element, stretched under load.
14. Strain gauge element, compressed under load.
15. Strain member or beam.
16. Cantilever support member.
17. Flexible member.
18. Fastener.
19. Platform support plate.
20. Base of apparatus.
21. Force sensor foot.
22. Lateral rib/rigid element.
23. Longitudinal rib/rigid element.
24. Foot platform surface.
25. Sensor pocket.
26. Computing means.
27. Communication means.

The following designations are given to the positions of the vertical force sensors shown in the figures:

LFL Left platform, front left.
LFR Left platform, front right.
LBL Left platform, back left.
LBR Left platform, back right.
RFL Right platform, front left.
RFR Right platform, front right.
RBL Right platform, back left.
RBR Right platform, back right.

Figure 1:
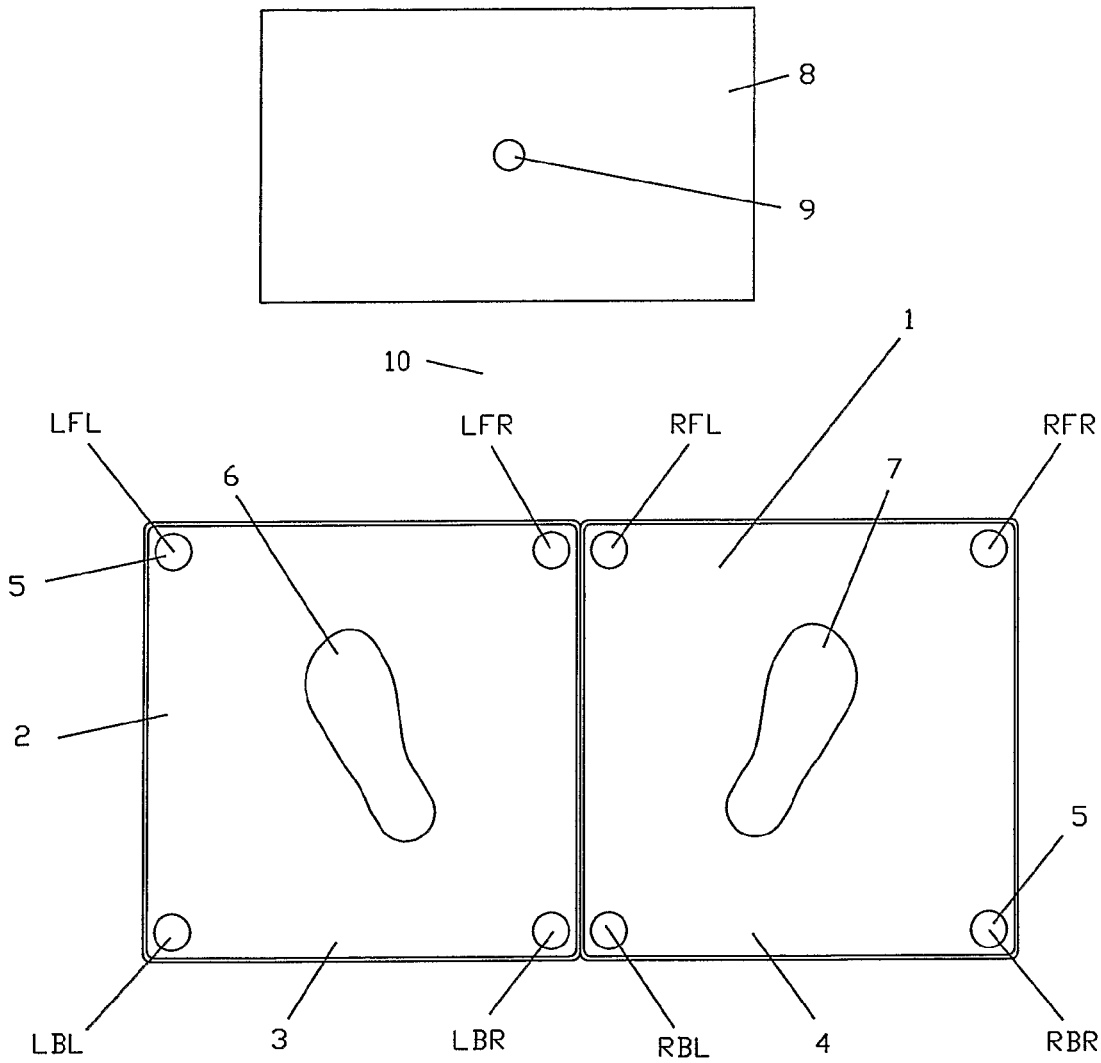
Figure 2:
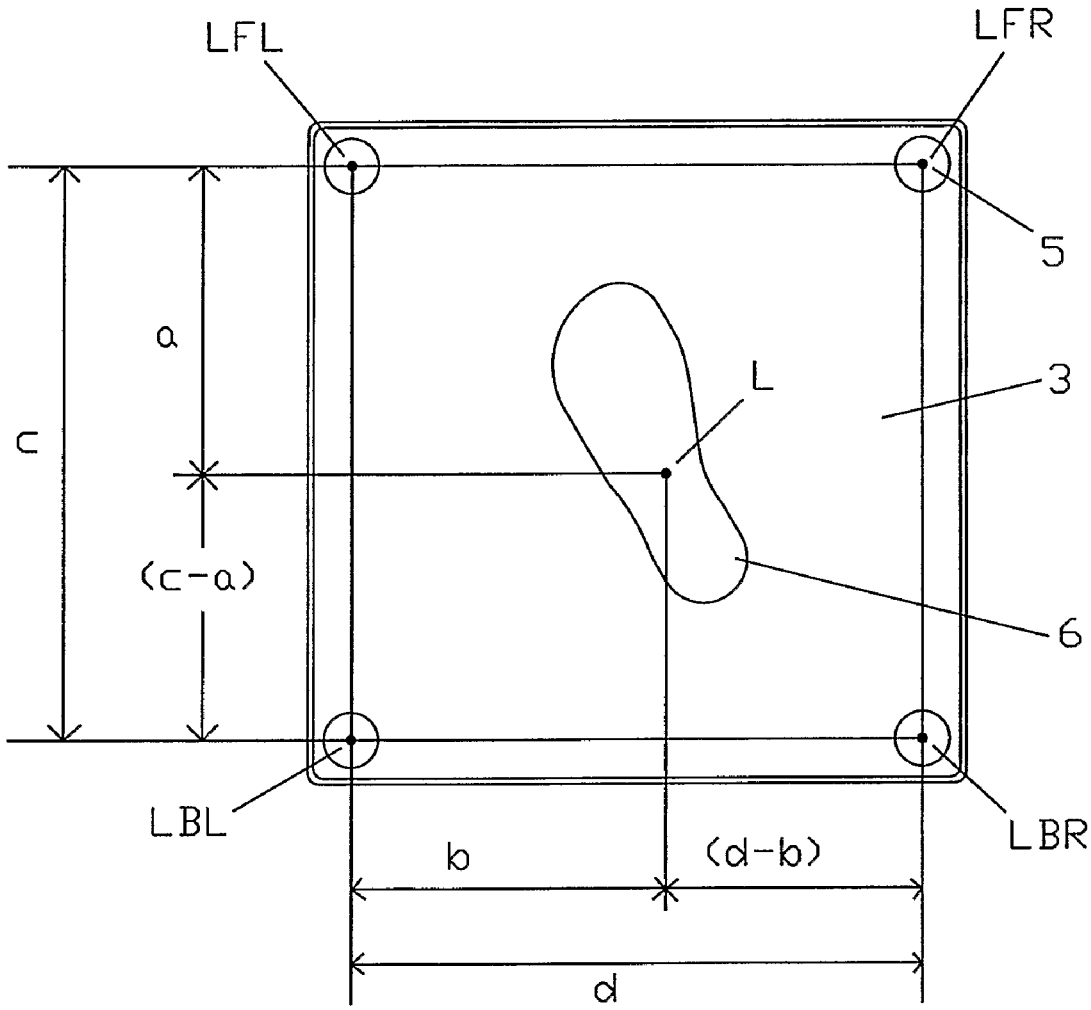

Reference is now made to FIG. 1 and FIG. 2 which show a plan view of a standing surface. The standing surface comprises side-by-side left and right platforms, each of which acts as a supporting structure, comprising a surface or effective surface. The surface, or effective surface, provides the required portion of standing surface. Each platform is supported by four vertical force sensor means, which will be referred to as sensors, each being located under the platform adjacent one of the corners. The positions of the sensors are shown in the figures although they are not actually visible in plan view. Any load applied to the platforms is distributed to the sensors.

The foot platforms are rectangular or square in plan view. The sensors are disposed symmetrically under the foot platforms. The centres of the four front sensors are co-linear as are the centres of the four back sensors. The centre of each front sensor is also laterally aligned with the centre of a corresponding back sensor.

Disposing the sensors in this symmetric manner provides several advantages. It simplifies mathematical calculations. It gives rise to a similar range of loads and load ratings on all sensors. It ensures that sensor loads are always positive vertical down forces.

The figures also show outlines of the shoes or feet of a player standing on the platform.

FIG. 2 shows an enlarged view of the left platform shown in FIG. 1. The centres of the front sensors are longitudinally spaced distance 'c' from the centres of the back sensors.

The centres of the left sensors are laterally spaced distance 'd' from the centres of the right sensors. The figure also shows the position of the resultant force downwards, 'L', exerted by the player's left foot on the foot plate. This force is spaced distance 'a' longitudinally from the centres of the front sensors and distance 'b' laterally from the centres of the left sensors.

The following designations are given to the vertical forces applied to each sensor, for convenience being the same as the designations given to the positions of the sensors shown in the figures.

LFL Left platform, front left.
LFR Left platform, front right.
LBL Left platform, back left.
LBR Left platform, back right.
RFL Right platform, front left.
RFR Right platform, front right.
RBL Right platform, back left.
RBR Right platform, back right.

Throughout the description and claims, unless otherwise stated, all forces refer to vertical forces or the vertical components of forces. Also references to forces may sometimes interchangeably refer to the vertically down acting force or to its exactly corresponding vertically up acting reaction force. Also, forces which result from a plurality of component forces may occasionally, although not always, be referred to as resultant forces.

The magnitude of L is known, since $$L=(LFL+LFR+LBL+LBR).$$

Balance-resolution of forces longitudinally about a line through LFL and LFR yields the following:—

$$(LFL+LFR+LBL+LBR)\times a=(LBL+LBR)\times c.$$

$$\text{Therefore, } a=(LBL+LBR)\times c/(LFL+LFR+LBL+LBR).$$

Balance-resolution of forces laterally about a line through LFL and LFR yields the following:—

$$(LFL+LFR+LBL+LBR)\times b=(LFR+LBR)\times d.$$

$$\text{Therefore, } b=(LFR+LBR)\times d/(LFL+LFR+LBL+LBR).$$

Since c and d are known constants and LFL, LFR, LBL and LBR are known from sensor measurements, the position of L, represented by dimensions a and b, is known.

The position and magnitude of the overall resultant force on both platforms, designated W, can also be readily determined.

$$\text{The magnitude } W=L+R=(LFL+LFR+LBL+LBR)+(RFL+RFR+RBL+RBR)$$

Figure 3:
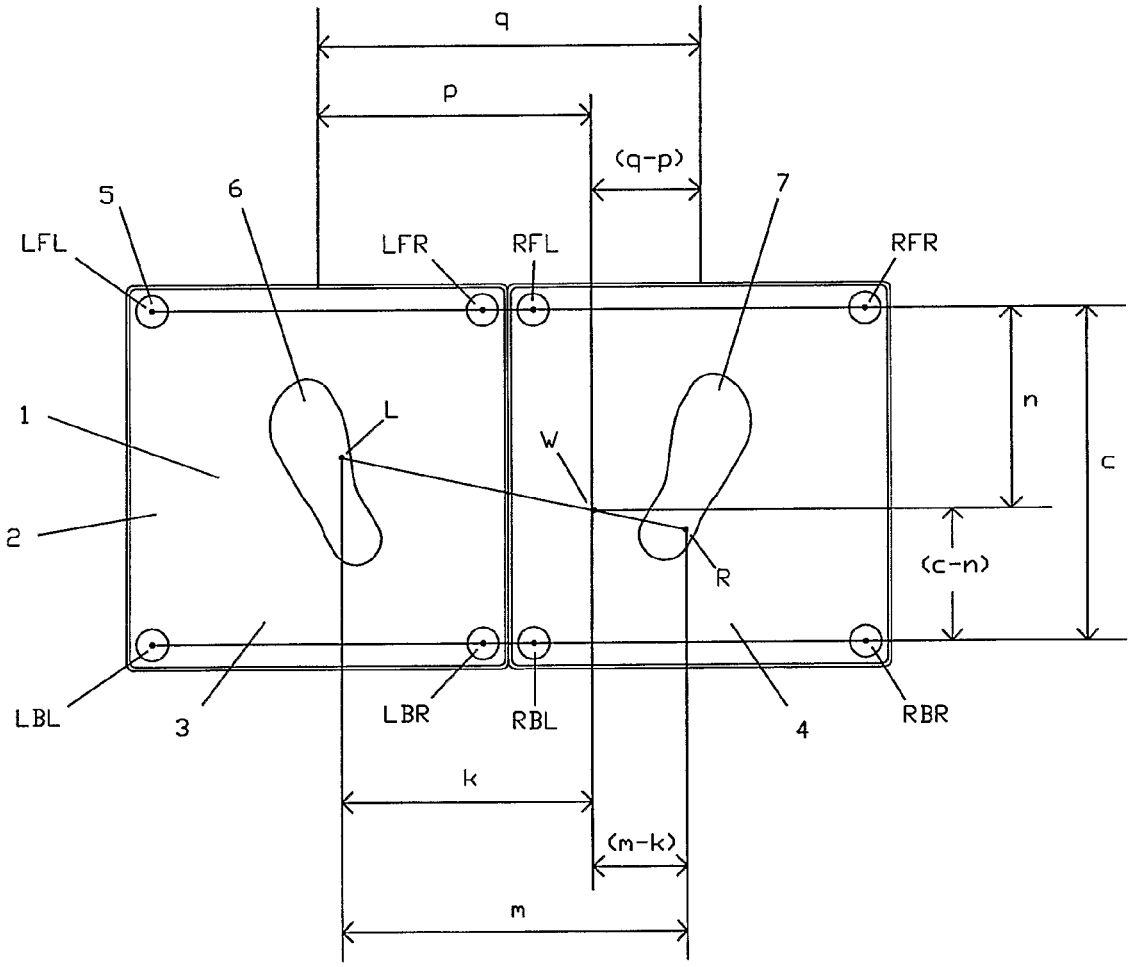

Reference is now made to FIG. 3, which shows a view of the standing surface and outlines of feet, similar to that shown in FIG. 1 and FIG. 2. The view shows the centre positions of sensors located at the four corner positions of each of the platforms. The view also shows the resultant forces, L and R, exerted by the left foot and right foot on the corresponding platforms, respectively, and the overall resultant force W exerted by the player. The view also shows the longitudinal distance between the forces and the centre positions of sensors, and the relative lateral distances between the forces.

Since by definition L and R are balanced about their resultant W, they may be resolved in any direction about W. Balance-resolution in the longitudinal direction yields the following:—

$$(LFL+LFR+RFL+RFR)\times n=(LBL+LBR+RBL+RBR)\times(c-n),$$

where c is the known longitudinal distance between front and back sensors known. This yields the longitudinal position of W.

The lateral position of W may be found by balance-resolution of R and L about W, using the known lateral positions of R and L.

Referring again to FIG. 3:—

$$L\times k=R\times(m-k), \text{ therefore } k=m/(1+L/R).$$

Distance m is known because the lateral positions of L and R are known. Therefore the lateral position of W can be determined.

An alternative, but less accurate, method involves balance-resolution of the forces R and L about W, but assuming them to act through the centres of their respective platforms. This yields relative positions of the resultant force, which may be acceptable for some calculated results. It has the potential advantage that it can be simply calculated from the magnitudes of the sensor readings without having to calculate the positions of L and R. Referring again to FIG. 3, the upper region of the view also shows the lateral distances between the overall resultant force and the centres of the platforms. Balance-resolution of W laterally about these platform centres yields the following:—

$$L\times p=R\times(q-p), \text{ therefore } p=R/L\times(q-p), \text{ therefore } p\times(1+R/L)=q\times R/L, \text{ therefore, } p=q\times R/L/(1+R/L)=q\times R/(R+L)=q/(1+L/R)$$

where p is the lateral distance of W from the centre of the left platform and q is the known fixed lateral distance between platform centres.

Taken alone, knowledge of the resultant force exerted by the foot is of limited use in evaluating performance. The downward vertical force is spread across one or more regions of the foot and some account should properly be taken of the distribution of this force relative to the overall position of the foot. Accordingly, an additional object of the invention involves the determination of methods which translate knowledge of the magnitude and position of the resultant force into usable determinations of the distribution of force relative to the overall position of the foot.

In a preferred embodiment, the device is provided with a computing means which is operable to determine foot position, or characteristics of foot position, by statistical analysis of a batch of resultant forces measured by the sensors where the player shifts weight with the foot in that position.

With the feet located in the required starting position for the swing, a representative sample batch of positions of the resultant forces on the platforms is collected. The representative sample batches may be conveniently collected by arranging the computing means to instruct or require the player to shift weight on his or her feet until sufficient diversity is measured, the criteria for which are discussed in further detail later. Where a golf swing is being measured, the process may be combined with the normal and recommended golfer's 'waggle' and 'address' techniques. When sufficient diversity is measured, this is communicated to the player by a visual or audible signal and the swing may then commence. Tests have shown that the process can be completed within a few seconds and is compatible with typical golf waggle and address activities, which take a similar length of time.

The criteria for sufficient diversity may be based on empirical knowledge of typical or relevant foot characteristics. Tests have indicated that a diversity of about 0.63 times foot length can be achieved at extreme front to back weight shift and about 0.54 times foot length with easy or ordinary front to back weight shift. In all cases foot length refers to the extreme length of the foot, toes to heel, along the long axis of the foot, and does not include the shoe. The requirement may therefore be set at about diversity to exceed 0.45 to 0.55 times anticipated foot length in a front-to-back direction, or in the direction of the best-fit line. Tests have also indicated that a diversity of about 0.17 times foot length can be achieved with easy or ordinary lateral weight shift on individual feet. The requirement may therefore be set at about diversity to exceed 0.10 to 0.18 times anticipated foot length in a side-to-side direction, or orthogonal to the direction of the best-fit line. The reason for requiring diversity is to ensure that the player provides a sufficiently wide spread of weight shift positions on each foot which cannot be skewed in an unrepresentative direction, for example, by waggling or addressing the ball with the foot rolled over to one side.

The sample batches are statistically analysed by the computing means to construct an appropriate best-fit straight line for each foot, approximately corresponding to the central long axes of the feet, running from the approximate central region of the heel to the approximate central region of the toes. The sample batch may be generated by sampling and recording the values of the resultant forces at regular intervals, for example approximately every millisecond. An appropriate best-fit line may be calculated by various well-established statistical methods which are suitable for operation on a computing means. Ideally, the best-fit line is based on a fit to the anticipated boundary within which the resultant forces fall and is not skewed by the relative frequency of resultant forces recorded within regions of the boundary. For example, a single resultant force recorded on one extreme side of the boundary should have the same influence on the position of the best-fit line as several resultant forces recorded on the opposite extreme side of the boundary.

The sample batches are also statistically analysed to determine a centre point for each foot, which may be arranged to fall on the best-fit line. This will be referred to as the 'statistical centre' and will correspond approximately to the position of the resultant force exerted by the foot when the force is centrally balanced at the foot, as in the case of a well balanced stance. The statistical centre may be conveniently determined as the midway position on the best-fit line between the furthest forward and furthest rearward values obtained in the sample batch.

Representation of the position of the foot by just two entities which can be expressed in simple mathematical terms, such as the line and point represented by the best-fit line and statistical centre, significantly facilitates the numerical analysis of the swing by the computing means.

It is important to check that the player does not inadvertently change foot position between the time when the computing means communicates acceptance of the diversity of the sample batch of resultant forces and the commencement of the swing. A change in foot position may comprise a total lifting of the foot from the foot platform, or it may comprise a slide of the foot to a new position, without it actually lifting from the foot platform, or it may comprise a rotation of the foot about the ball or heel, but with force remaining applied throughout the rotation by the part remaining on the foot platform.

Total lifting of the foot is readily detected by the computing means, because it causes the resultant force to reduce to zero value or close to zero value. Sliding of the foot, where force remains on the foot platform throughout the slide, is indicated by the subsequent detection of a resultant force outside the resultant boundary limits established for the foot position. These boundary limits may be set as a fixed relationship to the best-fit line and statistical centre for a given anticipated foot size. Rotation of the foot is indicated as a possible occurrence where toe or heel forces fall to zero value or close to zero value. The rotation is only proven if a resultant is subsequently detected outside the resultant boundary limits established for the foot position.

In a preferred embodiment, detection of the foot being lifted following the address but prior to the backswing, will cause the computing system to instruct or require the player to repeat the procedure of providing a sample of resultant forces prior to commencing the swing. Foot slide or rotation to a new position will invariably be detected too late to prevent the swing commencing, and the computing system instead evaluates the magnitude of the slide or rotation, against set criteria, to decide to what degree the results of the analysis remain valid and to communicate the results appropriately.

Detection and evaluation of foot lift, slide or rotation is also of importance during other stages of the swing, where they are sometimes deemed to constitute a fault. The computing means is provided with relevant available reference data to aid evaluation of detected foot movement.

The resultant force on the foot may be referenced to the position of the foot in various ways. In one relatively simple embodiment, the position of the resultant is referenced to the position of the best-fit line and to a second axis, orthogonal to the best-fit line and passing through the statistical centre. Thus the resultant force is judged to be at a neutral or balanced position when on the statistical centre, to move progressively laterally left or right when it moves progressively to the left or right of the best-fit line, and to move progressively towards the toes or heels where it moves progressively forward or rearward of the orthogonal line through the statistical centre.

Although the representation of forces on the foot by a single resultant force referenced to the position of the foot has an advantage of mathematical simplicity, nevertheless, it is a concept which is sometimes difficult to impart to an ordinary golfer, particularly where the golfer is unfamiliar with mathematical or scientific techniques. Many golfers find it easier to understand the concept of weight at the toes or heels, or percentages of weight at the toes or heels. In reality, the vertical down force exerted by the golfer's foot does not actually act at one resultant point or in discrete parts at the toes and heel, and both representations appear to have equal scientific validity.

In a further aspect of the invention, the resultant foot force is expressed in terms of heel and toe components, and an example is shown below of a technique which is suitable for operation by a computing means. The technique may be used as a primary or supplemental aid in the analysis of the swing and communication of the results to the player.

Throughout the description and claims, where reference is made to forces at the 'toes' and 'heel', these should be understood to also refer to what are sometimes termed forces at the 'front' and 'rear' of the foot, respectively, the terms being generally interchangeable. Also, where reference is made to toes or heel components of the resultant force exerted by the foot, it should be understood that such references may also apply to the equivalents of such forces, calculated by any appropriate technique, including the aforementioned technique where the position of the single resultant foot force is referenced to the position of the foot.

In a preferred embodiment using the concept of front and rear component forces, the resultant force on the foot is resolved into one front and one rear vertical force component, where these components are parallel and co-planar with the resultant. For convenience, these components will henceforth be referred to as 'toes' and 'heel' components, designated 'LT' and 'LH', where relevant to the left foot and 'RT' and 'RH', where relevant to the right foot. When viewed in plan view, the co-planar resultant and its components will appear as co-linear points. Again for ease of explanation, henceforth, the term 'co-linear' will be used to describe the co-linear or co-planar aspect of these components.

Various mathematical models can be used to resolve the resultant into relevant co-linear toe and heel components, where some knowledge of the general position of the foot is known. An example of such a model simulates largely lateral rolling motion of the foot, about the ball and heel, along the long axis of the foot. The example is illustrated in FIG. 4 and FIG. 5.

Figure 4:
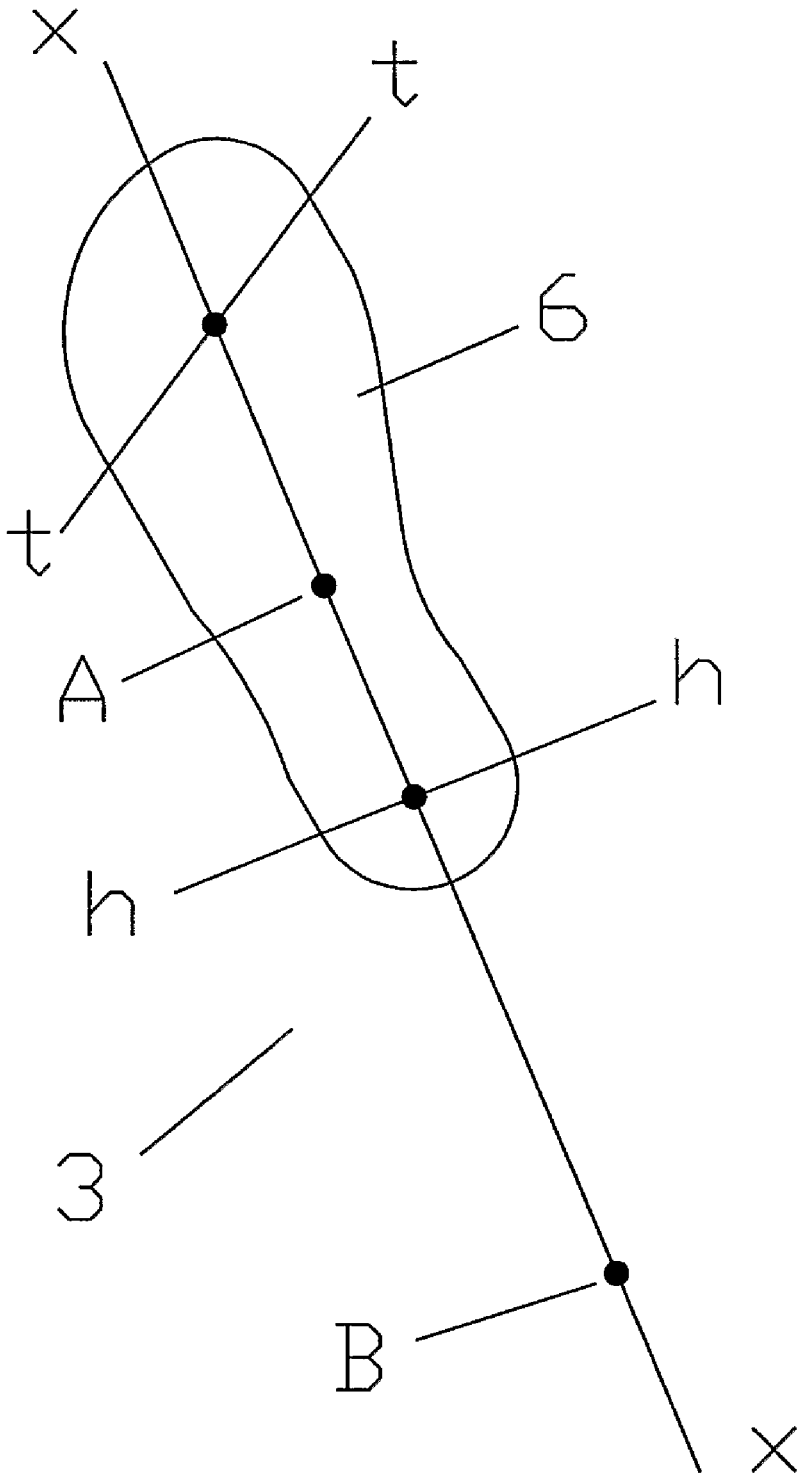
FIG. 4 shows a view of the outline of the left foot on the platform, similar to that shown in FIG. 2, but on a larger scale. The view shows the various model criteria constructed from analysis of a batch of resultant force data relating to the foot position.
Figure 5:
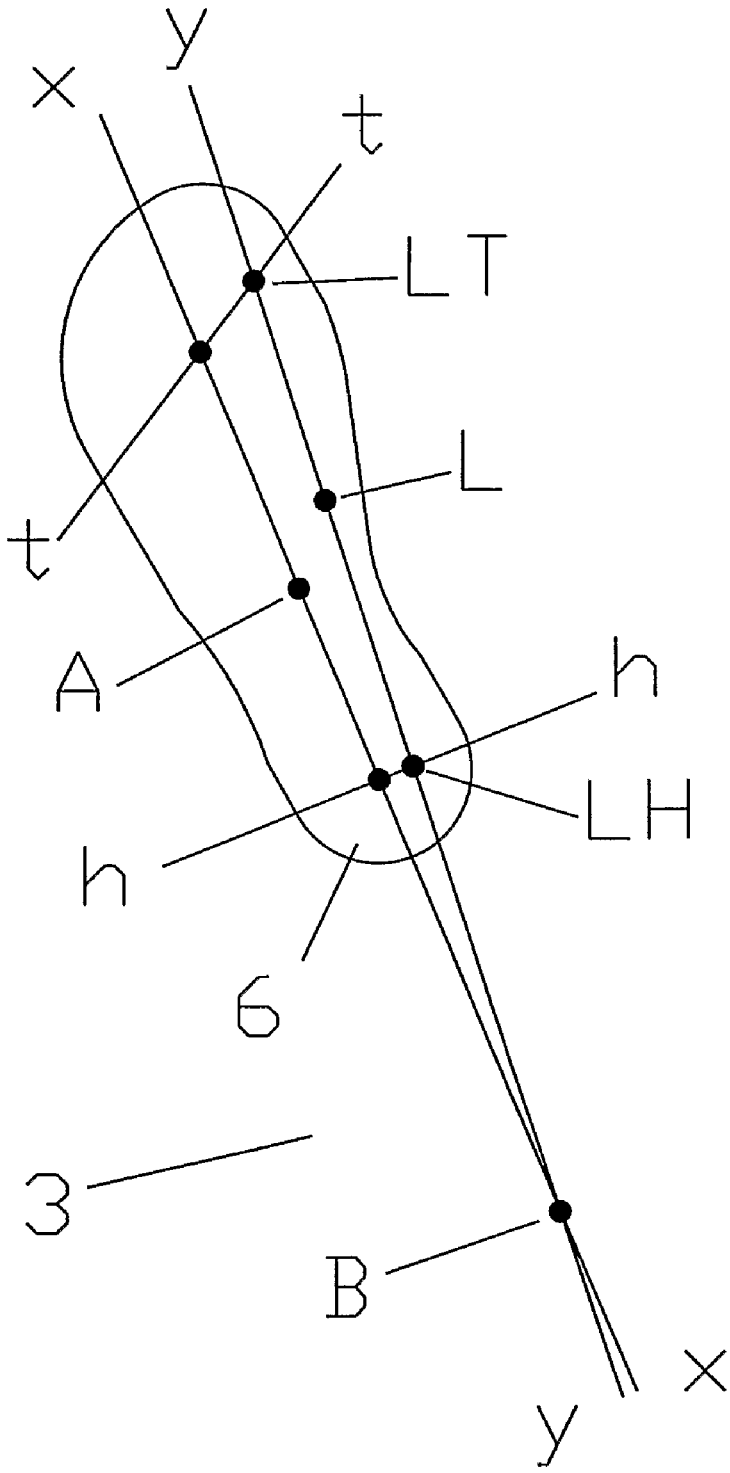
FIG. 5 shows a view similar to FIG. 4, but including a resultant force L and its model components LT and LH.

FIG. 4 shows a view of the outline of the left foot on the foot platform, similar to that shown in FIG. 2, but on a larger scale. The view shows model criteria constructed from analysis of a batch of resultant force data relating to the foot position, including a best-fit line shown as line 'xx' and a statistical centre shown as 'A' in the figure. FIG. 5 shows a view similar to FIG. 4, but including a resultant force L and its model components LT and LH.

The largely lateral rolling movement is about a rearward centre due to the effective rolling diameter of the ball of the foot being greater than the effective rolling diameter of the heel. The model reflects the relatively rigid characteristics of the player's foot and shoe between the regions of the heel and ball of the foot and provides a satisfactory estimation of typical foot characteristics.

Based on empirical knowledge of typical or relevant foot characteristics, a heel line may be determined in a predetermined relationship to the best-fit line and the statistical centre. The heel line approximates to the locus of the centre of downward force when the player exerts all of his or her weight to the most rearward positions on the heel. For example, the heel line may be determined as a straight line, orthogonal to the best-fit line, and set a predetermined distance, say approximately 0.35 times anticipated foot length, or between 0.30 and 0.40 times anticipated foot length, to the rearward of the statistical centre. A line if this type is shown as the central region of line 'hh' in the figure. Also based on empirical knowledge of typical or relevant foot characteristics, a toe line may also determined in a predetermined relationship to the best-fit line and the statistical centre. The heel line approximates to the locus of the centre of downward force when the player exerts all of his or her weight to the most forward positions on the ball of the foot and toes. For example, the toe line may be determined as a straight line lying at a predetermined angle, say approximately 60 o to the best-fit line, and intersecting it at a predetermined distance forward, say approximately 0.35 times anticipated foot length, or between 0.30 and 0.40 times anticipated foot length, of the statistical centre. The angles are of opposite rotation for the right foot and left foot. A line if this type is shown as the central region of line 'tt' in the figure. Again based on empirical knowledge of typical or relevant foot characteristics, a common point may be determined in a predetermined relationship to the best-fit line and the statistical centre, which will serve as the rearward centre of rotation of the rolling action of the foot, and will be co-linear with each resultant and its toe and heel components for the particular general foot position. For example, this centre of rotation may be determined as a point which lies on the best-fit line at a set distance, say approximately 0.80 times anticipated foot length, or between 0.65 and 1.00 times anticipated foot length, rearward of the statistical centre of the sample. A point of this type is shown as 'B' in the figure.

Optionally, the various model parameters may be varied with player characteristics, such as the player's shoe size, weight, sex or age. Some player parameters may be obtained directly by the apparatus. For example, the player's weight will be immediately known from the static sum of the resultant forces on the platform.

The model thus constructed can be used to determine the position and magnitude of the toe and heel components of any resultant force occurring for the same general foot position. Where a new resultant force L occurs, a line is determined which passes through L and the centre of rotation B. The positions of its toes and heel components, LT and LH, are determined as the intersections that line with the toes line tt and the heel line hh, respectively. This is illustrated in FIG. 5, which shows the same foot position and model as shown in FIG. 4. The line is shown as 'yy' in the figure.

Figure 6:
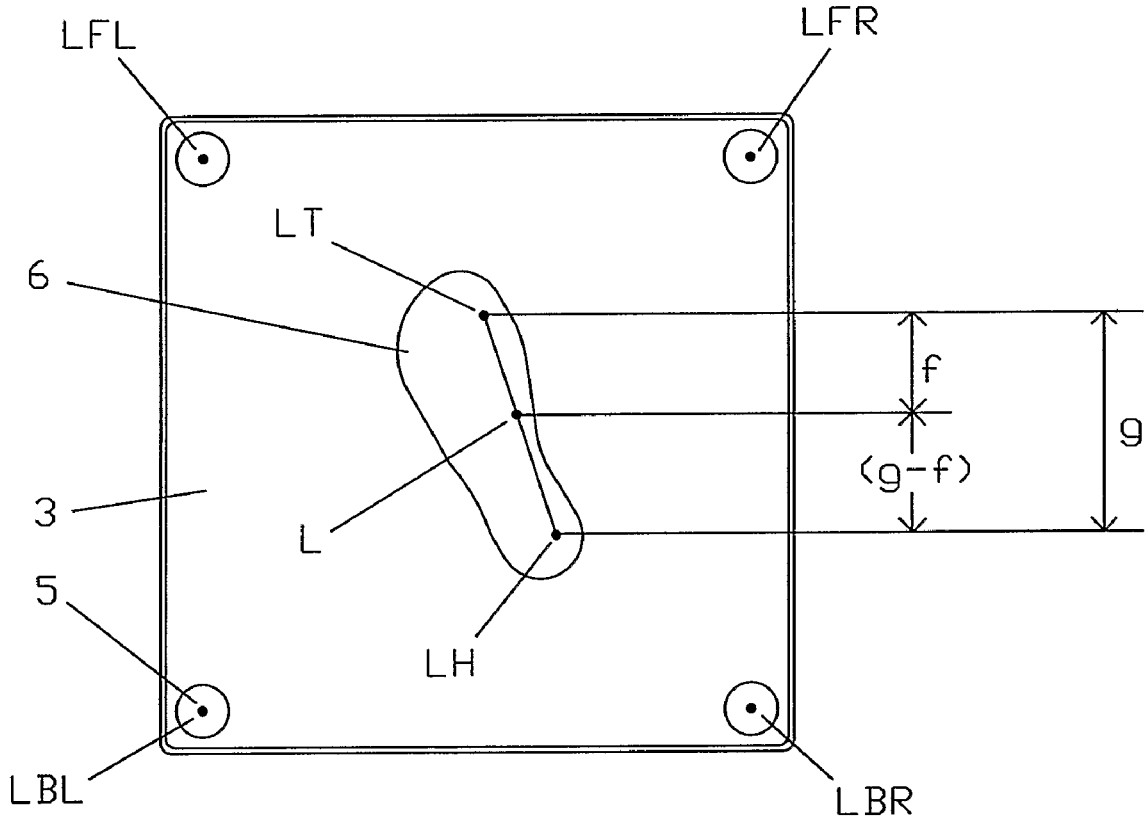
FIG. 6 shows a view similar to FIG. 2, but including the forces L, LT and LH shown in FIG. 5, together with longitudinal distances between them.

The magnitudes of the components LT and LH are found by balance-resolution of the components about the resultant L. Referring now to FIG. 6, the relative positions of L, LT and LH are shown projected onto the longitudinal axis. LT is spaced distance 'g' longitudinally from LH, and distance 'f' longitudinally from L. The values of g and f are known, since the positions of LT and LH are known from the model. Since by definition LT and LH are balanced about their resultant L, they may be resolved in any direction about L. Resolution in the longitudinal direction yields the following:—

$$(LT)\times f=(LH)\times(g-f),\ \text{therefore}\ (LH)=(L)\times(f/g).$$

$$\text{Also},\ LT=L-LH.$$

Since L, f and g are known, therefore the magnitudes of LT and LH are known.

Throughout the description and claims, the terms 'foot-aligned-longitudinal' and 'foot-aligned-longitudinally' shall refer to the horizontal direction aligned to a long axis of the foot, and the terms 'foot-aligned-lateral' and 'foot-aligned-laterally' shall refer to the side-to-side horizontal direction at 90° to the foot-aligned-longitudinal direction. Depending on the method of calculation chosen, the long axis may comprise the central best-fit line, or it may comprise the relevant long axis passing through the centre of rotation B.

In a preferred embodiment, the sensor means comprises a strain gauge force sensor, with each sensor comprising two opposed strain gauge members. An example of a sensor of this type, suitable for use in the apparatus, is shown in FIGS. 7*a* and 7*b*. The sensor is positioned beneath a support point on the platforms and is operable to produce an electrical output voltage signal which varies with applied vertical load. The sensor comprises a simple robust metal strain member or beam, one end of which is strongly fastened to a robust cantilever support member which is fastened to the base of the apparatus. The other end of the beam is similarly strongly fastened to a second robust support member which is fastened to a flexible member, which in turn is fastened to the platform. These two opposed cantilever arrangements, in conjunction with the flexible member, allow a substantial vertical force, applied to the force sensor, to be transmitted to the base, without imposing significant bending forces or side forces on the base or platform. The flexible member may comprise, for example, a solid elastomer moulding or alternatively, a metal or polymer spring member. The two opposed cantilever arrangements remain substantially parallel when a vertical force is applied, and the beam is slightly deformed with two shallow bends, one to each side of centre on the same surface, causing the region of the surface to one side of centre to be slightly stretched and the region of the surface on the other side of centre to be slightly compressed.

The sensor comprises two matched strain gauge elements in a strain gauge assembly which is bonded to one surface of the strain beam, with strain gauge elements disposed on either side of centre of the strain beam surface, such that one is stretched and the other is compressed when a load is applied to the sensor, causing one to decrease and the other to increase in resistance.

The two strain gauge elements are connected in a Wheatstone bridge configuration with two fixed resistances to provide an output signal which is proportional to the sum of the outputs from the two strain gauge elements.

The use of two opposed strain gauge elements in this manner has several advantages, including the following. It largely obviates the effects of temperature changes on the sensor, because the effect on the stretched element balances the effect on the compressed element. In a similar manner, it also partly obviates the effects of voltage variations. It increases accuracy by doubling the output signal from the sensor. It also increases accuracy by the averaging effect of using two rather than one element. It further helps to increase accuracy by producing a nominal zero voltage output at no load, where the bridge is properly balanced, whereas the absolute resistance of a single strain gauge element produces a less well defined output voltage at no load.

FIGS. 8*a* and 8*b* depict an alternative example of a force sensor which is similar in construction and operation to that shown in FIGS. 7*a* and 7*b*, but differs in that the lower part of the sensor is attached to a sensor foot rather than to an apparatus base, and also differs in that the flexible member is connected to the lower cantilever beam support. This arrangement has a relative advantage over that shown in FIGS. 7*a* and 7*b* in that it dispenses with the need for an apparatus base. However, it has the relative disadvantage that the sensors are less securely supported and are likely to require a firmer or more even surface.

Referring again to FIG. 1, the view shows the two foot platforms, a ball and a playing mat. The ball is typically disposed at a position lying along a substantially straight locus which varies with club length used in the swing. Its outermost position, corresponding to that used with the driver club, lies on a line which extends orthogonally, to the target or intended direction of travel of the ball, from a position close to the player's inside heel position, when the player's foot is placed centrally on the left foot platform. Its innermost position, corresponding to that used with the shortest club, lies on a line which extends orthogonally, to the target or intended direction of travel of the ball, from the division between the two foot platforms. The distance between the insides of the left and right heels can vary considerably, but will usually be no more than the width of the player's shoulders during a drive swing, and will be progressively less for swings with shorter clubs. The ball may be held in position by any suitable means, including positioning on a tee or on at a specific point on the playing surface. The playing mat may comprise a surface such as is used in a golf driving range and may comprise a durable artificial turf. Its surface should be at the same elevation as the surface of the foot platforms. The arrangement shown in FIG. 1 will satisfy the normal level range of golf swings, provided the ball is moved closer to the foot platforms for shots with shorter clubs. The ball position is progressively moved closer to the division between the platforms as the ball is positioned closer to the platform.

The position of the ball relative to the foot platforms is of importance, because the apparatus evaluates the player's chosen standing position relative to the ball and also evaluates the player's movement and weight shift relative to a notional target or intended direction of ball flight, which is related to the position of the ball relative to the foot platforms. The relative position of the ball may be set in various ways.

In one example, the playing mat is of relatively large size and its position is fixed in relation to the foot platforms. The ball is positioned on a tee which locates in a hole, or at a fixture, in the mat. The mat is provided with a plurality of such holes or fixtures lying along the locus of proper positions for the tee, depending on club length. In an alternative example, the playing mat is of size similar to that shown in FIG. 1 and is held in spaced apart relationship from the foot platforms by a spacer member, which is not shown in the figure but where its location is indicated. The ball is positioned on a tee which locates at a unique position on the mat. The spacer member is operable to engage the mat and the main portion of the apparatus, including the foot platforms, in a plurality of positions, but in each case with the tee position on the locus of proper positions of the tee using an engagement means such as arrays of obliquely disposed teeth which engage with corresponding notches in the mat and main portion of the apparatus.

The platforms comprise structural supporting surfaces which must be sufficiently strong and rigid to withstand the weight and dynamic forces of a player executing a golf swing. Typical maximum vertical forces, including centrifugal and reaction forces, may be about 750 N on the right foot and 1000 N on the left foot. The foot platforms may, for example, be fabricated as polymer mouldings, strengthened with ribbing on their undersides. The upper surfaces may be provided with a flexible grip material, such as an elastomer mat.

In a preferred embodiment, the foot platform comprises a surface which has differing rigidity in different orientations in the horizontal plane, with increased rigidity across pairs or sets of sensors where the surface is required to have beam strength and with reduced rigidity across pairs or sets of sensors where beam strength is not desired. For example, where the platform is supported by four sensors, as depicted in FIG. 2, platform beam strength is required between LFL and LFR, between LBL and LBR, between LFL and LBL and between LFR and LBR. However, platform beam strength is not required and is undesirable between LFL and LBR and between LFR and LBL, where the sensors are diagonally disposed relative to each other. Beam strength between these diagonally disposed pairs of sensors could give rise to incorrect readings because they could prevent the vertical forces being properly distributed to the sensors where there is any unevenness in the ground support of the sensors or in the shapes or dimensions of the platform or the sensors themselves.

An example of a foot platform with differing rigidity is shown in FIGS. 9*a*, 9*b* and 9*c*.

FIG. 9*a* shows an underneath view, FIG. 9*b* shows a side sectional view on X-X and FIG. 9*c* shows a side sectional view on Y-Y of an example of a foot platform of this type, suitable for use on an apparatus of the type shown in FIG. 1. The foot platform comprises two relatively very strong and rigid laterally disposed rigid elements, one spanning its two front sensors and the other spanning its two rear sensors. A plurality of longitudinally disposed, relatively strong and rigid, spaced apart rigid elements span the two laterally disposed rigid elements. The laterally disposed rigid elements are individually stronger than the longitudinally disposed rigid elements. A relatively flexible horizontal surface connects the upper surfaces of all of the rigid elements. The platform is produced as a single polymer moulding, with the upper surface forming the horizontal surface, and with integral ribs forming the rigid elements. Pockets are integrally moulded into each corner, which encapsulate the sensors and transfer the force from the ends of the laterally disposed rigid elements to the upper surfaces of the sensor. The pockets are strongly joined to the laterally disposed rigid elements, which comprise deep thick ribs integral to the moulding. The longitudinally disposed rigid elements are strongly joined to the laterally disposed rigid elements and also comprise ribs integral to the moulding, but are of lesser thickness and depth than the laterally disposed rigid elements. When a concentrated force is applied near the centre region of the platform, it is transferred to the adjacent underlying longitudinally disposed rigid elements, which in turn distribute the force to the four pockets and corresponding supporting sensors. If the support for any of the sensors deflects downwards by a small amount, the force on the sensor remains substantially unchanged because the platform is capable of flexing across its diagonal without appreciably altering any of the individual forces applied at the four corner sensors. The arrangement can also, of course, be similarly achieved with two longitudinally disposed rigid elements and a plurality of spaced apart laterally disposed rigid elements. The arrangement can also be achieved with the continuous surface being replaced with an effective surface, with openings between portions of the plurality of rigid elements.

In a preferred embodiment, the rigidity of the base is arranged to exceed that of the foot platform, with the maximum deformation of the base under working conditions corresponding to a flexing of the foot platform within its normal operating range and with sufficiently little resistance to flexing such that forces distributed to the sensors are not significantly affected.

The apparatus may also receive and process additional signals from sensors which measure horizontal forces on the foot platforms. The addition of such sensors to the apparatus has the potential advantage of increasing the scope and accuracy of the analysis. It has the potential disadvantage that it significantly increases the cost and complexity of the apparatus.

The apparatus is provided with a computing means, which receives signals from the sensors and is operable to measure, memorise and analyse these signals and communicate the results as required. Voltage signals from the sensors may typically be amplified in amplifier circuits and converted from analogue to digital format within the computing means, where subsequent manipulation of the signals takes place.

Sensor signals should be sampled at a reasonably fast rate, for example at least 1200 signals per second, and then converted to digital format. The signals are smoothed, for example, by converting them to a rolling average of one signal to a cluster or several surrounding signal values. The computing means identifies particular periods of the swing which can be advantageously analysed in finer time detail than other periods, such as the transition period from backswing to downswing, and typically analyses these periods in the finest time details available. Other periods can be analysed in coarser time details, which can reduce the number of calculations required and thereby advantageously increase processing speeds and reduce memory requirement. Attention should be given to minimising signal to noise ratios in the sensors and related circuits to allow fine time detail of the signals and to minimise necessary smoothing.

The computing means may comprise, for example, an electronic processor or computer, or a link to a processor, computer or external system, such as the internet or other communication network, or any combination of these. The computing means may also comprise software, programs, data and systems used with any of the above devices or systems.

The apparatus also comprises a communication means by which the results of the measurements and analysis are communicated either directly or indirectly to the player or operator of the apparatus or to other parties or apparatus or communicated for further storage or use within the computing means. Indirect communication includes communication of signals or data to other devices capable of direct communication or further indirect communication.

FIG. 10 is a block diagram showing the connection links between the sensing means, the computing means and the communication means. The computing means links to the sensor means and to the communication means. Connection links may comprise, for example, radio links or electrical wires or circuits.

The apparatus of the invention may be programmed to evaluate the golf swing in accordance with any set of criteria or views as to what constitute good or bad elements or methods in a swing. The following provides a brief outline of a typical set of such criteria relevant to the apparatus of the present invention.

When the ball is addressed, prior to the backswing, ideally weight is distributed equally between the left and right feet. Weight on the heel end of each foot is a little greater than on the toe end. Foot positions are important, relative to the position of the ball, the intended direction of flight of the ball and the type of shot being taken. Usually, a slightly open stance is favoured, to assist the player to open the swing, with the left foot angled about 20° anticlockwise from a square position. The right foot may typically be angled about 7° in a clockwise direction.

The use of the large muscles of the legs and body are essential in effecting a proper powerful golf swing. The use of these muscles results in a weight shift, and measurement of this weight shift is advantageously used to analyse the proper use of these large muscles at appropriate times during the swing. The maintenance of balance and control is also of extreme importance during the swing.

In practice, during a properly executed backswing, the player's weight shifts from a balanced address to increasing weight on the toes of the left foot and heel of the right foot, all of the time either smoothly moving the overall centre of gravity laterally to the right or maintaining it in a reasonably central balanced position, or some combination of these two. This type of proper weight shift and balance can be monitored by measurement of certain vertical foot forces. In addition, to achieve an effective and powerful swing, it is necessary for the player to brace himself or herself with a controlled stance against the natural reaction, in the opposite direction to the target, as the club is accelerated towards the target. The backswing determines the rotation, weight shift, wrist cock and spring loading of the muscles prior to the downswing, and if executed correctly will greatly assist in the promotion of a proper downswing.

In the transition from backswing to downswing, the downswing movement of the hips commences prior to the completion of the backswing movement of the club. The backswing time is typically about 0.9 seconds. The downswing to impact time is typically about 0.3 to 0.4 seconds. In a well executed swing, the backswing and downswing may overlap by about 0.1 seconds.

The degree of relative rotation of the shoulders in relation to the hips is important at the end of the backswing. A further increase in the degree of relative rotation of the shoulders in relation to the hips, sometimes referred to as the 'x-factor stretch', is considered to be advantageous in the early part of the downswing with a view to obtaining additional power in the swing.

During the downswing, toe to heel weight transfer typically reverses, properly moving smoothly from toe to heel on the left foot and, to a lesser degree, from heel to toe on the right foot. By the end of the downswing, the majority of overall weight is on the heel of the left foot. The timing and direction of weight transfer, or overall down force movement, is important in the downswing. It should not commence prior to the downswing and should be generally in the target direction or a little out towards the left toes, progressing smoothly throughout. During the first stage of the downswing, most body and hip rotation occurs accompanied by a significant amount of toe-to-heel weight shift and also some general weight shift from right to left. The head of the club is accelerated throughout this stage with much of the energy supplied by the large muscles of the legs and body, with the club being largely pulled in its orbit. Technically, this pulling stage may continue over about 60-70% of total downswing duration. The second stage of the downswing may, for example, be defined as the remaining portion of the downswing, to the point of impact between the club head and ball. During this second stage, most of the body and hip rotation has already occurred. The head of the club continues to accelerate with much of the energy now being supplied by the arm muscles. The head of the club is also assisted in direction towards the target direction by weight shift in that direction.

The apparatus can detect several distinct features in vertical down forces during the downswing which are associated with the rotational deceleration of the pelvis and trunk during the downswing, including a set of distinct inflection points associated with the commencement of acceleration, which for convenience will be termed the 'pre-surge force points' and a set of distinct inflection points associated with the transition to deceleration, which for convenience will be termed the 'peak force points'. Some of these forces are also due to vertical translation of the body. Rotational deceleration may typically show with pre-surge and peak forces predominantly on the left foot, due to the bracing effect of the foot, while vertical translation may typically show with these forces pre-dominantly balanced across both feet.

The downswing advances to the point where the club impacts with the ball and then to the follow-through stage as the club continues along the swing arc. The ball to club contact time is about 0.00045 seconds. Although the club abruptly decelerates at impact, the progression is otherwise smooth. The majority of weight remains on the left foot after follow-through.

As an important part of the analysis, the computing means maps out the times of various detectable principal events which are common to all normal swings. These will be referred to as 'feature events' and will provide a general frame of reference for the analysis. The principal feature events include the commencement of the backswing; termination of the backswing; commencement of the downswing; pre-surge point in the downswing; peak force point in the downswing; and impact of the club head with the ball. Most of these principal feature events comprise component events which may differ slightly in timing. For example, the commencement of the backswing; termination of the backswing and commencement of the downswing may be slightly different for club head movement, shoulders movement and hip movement aspect of backswing and downswing. The pre-surge and peak force points are usually slightly different for the left foot, right foot and combination of feet. In all of these cases, the differences may be small but can be very significant.

In creating the framework of feature events, the computing means is aided by knowledge of typical sequences of feature events and the probabilities of their occurrences at times relative to each other for different types of swings in different circumstances. Each stage of the swing will have a typical readily determined time relationship, one to the other, for different types of shots and circumstances, which can be pre-programmed into the computing means or otherwise made available to it. This information can be used to aid the computing means in restricting the search for a feature event within time limits within the swing, relative to other feature events, and to assign probabilities to finding feature events at different time periods within these time limits.

The computing means may also be aided by knowledge of the player's swing. Such information may, for example, have been recorded during previous swings and retained in a log or memory. It may be used to refine the likely times and probabilities of the times of feature events relative to each other.

The following paragraphs describe an example of an embodiment of the apparatus where the computing means determines the framework of event features in a swing measured by the apparatus. To assist explanation, the event features are set out in typical chronological sequence, although their actual calculation is unlikely to be carried out in this order.

The computing means is initially alerted to the likely commencement of the backswing when acceptance of sufficient diversity of foot weight movement is communicated to the player as part of the process of determining foot position.

The computing means is provided with additional sensing means, located at the address region at the rear of the ball, which determines the commencement of club head back swing by sensing when the club head departs the address region. Such sensing means may comprise, for example, electromagnetic beams which are emitted and received laterally across the address region. The beams may be generated by laser diodes and detected by photodiodes. The presence of the club head in this region disrupts the beams and its departure from the region is detected by the reinstatement of the beams.

The computing means also determines the commencement of general backswing by detecting a fluctuation from a period of least change to a period of sustained change across a selected range of variables, including foot, toes and heel force positions and magnitudes on both feet. This fluctuation, which typically has a detectable ramp-up duration characteristic, may occur before, simultaneously or after the detected commencement of club head related commencement of backswing. Differences between commencement of these two feature events are of significance in the later analysis.

The computing means additionally determines the transition from the backswing to the downswing. The transition can be complex as some components of the end of the backswing can overlap components of the commencement of the downswing. The computing means detects the complex transition by a variety of different methods, the results of which will, for convenience, be referred to as 'indicators'. Due to the wide variety of swing types and swing errors, and also to the different commencing and ending aspects, no single indicator accurately determines the time of the transition. Some of the principal indicators of the transition are described in the following paragraphs.

One of the most important groups of indicators of the transition relates to the points in time of maximum difference between the forces on the toes and heels of the foot, or if this occurs over a period of time, the point in time where it moves away from this period of maximum difference. It is noted that this indicator is the same as the resultant force on the foot moving to an extreme foot-aligned-longitudinal position. Usually the forces at the toes are greater than the forces at the heel for this indicator. There are two indicators in the group, one for the left foot and one for the right foot. The indicators may be present on both feet or on just one of the feet.

A further important group of indicators of the transition relates to the points in time of a reversal of movement of the positions of the foot-aligned-lateral or foot-aligned-longitudinal, or lateral or longitudinal, components of force on the left foot or the right foot. The reversal of the foot-aligned-lateral component usually occurs from a direction to the right to a direction to the left. The reversal of the foot-aligned-longitudinal component is usually a weaker indicator than that of the foot-aligned-lateral component and more often than not occurs only locally rather than across the broad movement of the force. The transition may be indicated by all or any of the four indicators in this group.

An additional important group of indicators of the transition relates to the points in time of a change of direction of movement of the positions of the lateral or longitudinal components of combined force on both feet. In the case of the lateral component, the change will usually be a complete reversal, most commonly from right to left, but sometimes from left to right. In the case of the longitudinal component, the change will usually be less pronounced and will commonly comprise a fairly sharp change in general direction, but not a reversal. The reversal of the longitudinal component is usually a weaker indicator than that of the lateral component. The transition may be indicated by one or both of the two indicators in this group.

Another important indicator of the transition is the point in time of a detection of a fluctuation from a period of sustained change, to a relatively short period of least change and back to a period of sustained change, across a selected range of variables, including foot, toes and heel force positions and magnitudes on both feet. This reflects the relative quiescence of the transition, where the body and club system come to relative rest, between the more energetic backswing and downswing activities.

A further indicator of the transition is the point in time of a minimum value of force on the left foot, or the beginning of a period of minimum value of force on the left foot.

An additional indicator of the transition is the point in time of a significant change in the rate of change of differences in the magnitudes of the force between the left foot and the right foot.

A further indicator of the transition is the point in time of cumulative vertical momentum returning to the same zero value as existed at the beginning of the backswing. This indicator only works well for a player, together with his or her club, who becomes momentarily quiet, at least in a vertical direction, at the beginning and end of the backswing. The attainment of cumulative vertical momentum may be readily determined by summing the value of the combined force on both feet, at short regular time intervals, relative to the player's static weight, commencing just before the beginning of the backswing. Values of force greater than the static weight are taken as positive and values less than the static weight are taken as negative. The sum will attain zero value when cumulative vertical momentum returns to its starting value of zero.

The computing means uses some or all of the indicators to obtain the most accurate assessment of the time of occurrence of the transition. A weighting is assigned to the results of each indicator to give a weighted average or weighted determination, where weighting is partly dependent on a pre-assessment of the relative importance of the indicators and is partly dependent on an assessment of the strength of the result from each indicator.

The computing means may also estimate the relative positions of the components of the transition from the results of the various indicators, since the indicators do not correspond equally with the different components of the transition feature events. The relationship of the indicators to these components may be fairly readily established by trial.

The computing means determines the points in time of a group of event features comprising the pre-surge force points. These occur prior to the rapid increase in force due to the motion of the pelvis and trunk in the downswing and typically comprise notable inflection changes in the values of force which change either from a minimum value or from a period of relatively constant value from the commencement of the downswing. The group usually comprises three feature events, one corresponding to the combination of both feet, one to the left foot and one to the right foot. However, in some instances only two pre-surge points may occur, one due the combination of both feet and one due either to the left foot or right foot, most commonly the left foot.

The computing means determines the points in time of a group of event features comprising the peak force points. These are related to the pre-surge force points and also occur prior to the rapid increase in force due to the motion of the pelvis and trunk in the downswing. They comprise the maximum peak values of force. Similar to the pre-surge force points, the group usually comprises three feature events, one corresponding to the combination of both feet, one to the left foot and one to the right foot. However, in some instances only two peak force points may occur, one due the combination of both feet and one due either to the left foot or right foot, most commonly the left foot.

The computing means determines the time of impact using a sensing means which can detect an event related to the time of impact of the club head with the ball, In one embodiment, this sensing means is located in the address region at the rear of the ball, and detects the return of the club head to the address region, for example, by detection of the interruption of an electromagnetic beam or set of beams in this region. The same sensing means may be used to detect the commencement of the backswing and the time of impact. The computing means may associate the time of impact with a time very shortly following disruption of the beam. In an alternative embodiment, a microphone may be used to detect the sound of impact.

The computing means analyses the swing by determining or evaluating the various force inputs from the sensors against the framework of feature events, the determined positions of the feet and a body of information available to it which, for ease of explanation, shall be referred to as 'available reference data' throughout the description and accompanying claims.

Available reference data may be divided into various categories, with a primary category comprising information related to known golf swing performance, including criteria which allow different aspects of the performance to be judged or graded against what is considered to be good or bad performance when the available data is prepared. Such available reference data will vary for different circumstances, including different types of swings and different player skill levels. Typically this type of available reference data may be provided to the computing means through pre-prepared software which is loaded onto, or otherwise available to the computing means or is pre-loaded onto the hardware of the computing means. The computing means may have access to a wide variety of items of such software, some or all of which may comprise different sets of available reference data.

Another category of available reference data comprises information which is accessible by the computing means concerning previous swings made by the player or information on the player or his or her previous performance held in a player's information log. For example, such information may comprise details of a player's swing strengths and weaknesses, such that performance may be judged against the player's strengths and weaknesses rather than against general golf standards.

The computing means may analyse the swing without reference to other external apparatus or sources of information. It may also be operated in conjunction with apparatus or systems which provide further information on the swing. For example, the computing means and apparatus of the invention may be run in co-operation with apparatus which measure the movement characteristics of the club and the ball. Where such apparatus or external sources are used, the available reference data may be appropriately modified to incorporate or accommodate the additional information available from the external apparatus or sources.

Analysis by the computing means may take various forms and serve various functions. For example, it may include direct evaluation of a golf swing communicated to a player, or it may be used with interactive training processes where the results of the analysis are not communicated to a player but are instead used to prompt a training element within the computing means software.

Examples of typical analysis processes which can be carried out by the computing means are given in the following paragraphs.

The computing means evaluates foot positions by comparing particular foot position characteristics to relevant available reference data. The particular characteristics will typically include distance between foot positions; alignment of the combined lateral axis of the feet with the target direction; alignment angles of individual feet; and longitudinal and lateral distance of the feet from the ball position.

The computing means also determines and evaluates characteristics comprising durations between feature events in the swing, and relative relationships of durations between feature events in the swing, by comparing these characteristics with available reference data. The characteristics include absolute values of durations of backswing; downswing; total swing; portion of downswing from start to pre-surge force point; portion of downswing from pre-surge force point to peak force point; portion of downswing from peak force point to impact. The characteristics also include the ratios of various of these absolute values to each other.

The computing means further determines and evaluates smoothness and regularity of change of the magnitudes and positions of forces over certain elements of the swing. These provide a measure of proper natural movement and balance which are (important) to accuracy and power in the swing. Relevant forces and elements include:—Left foot, and right foot, toe and heel forces during the backswing; Left foot, and right foot, toe and heel forces during the downswing; Left foot, and right foot, lateral and foot-aligned-lateral foot forces during the backswing; Left foot, and right foot, lateral and foot-aligned-lateral foot forces during the downswing; Left foot and right foot resultant forces during the backswing; Left foot and right foot resultant forces during the downswing; Combined left and right foot resultant force during the backswing; Combined left and right foot resultant forces during the downswing.

The computing means additionally determines and evaluates the player's pelvis related movement by determining the degree of transfer of force from the heel to the toes on the left foot and from the toes to the heel on the right foot, in the backswing, and the degree of transfer of force from the toes to the heel on the left foot and from the heel to the toes on the right foot, in the downswing, and comparing the values to available reference data. The available reference data may include ranges of ratios of toes/heel force values at the beginning and end of the backswing and the beginning and end of the downswing.

The computing means also determines and evaluates the timing, direction and magnitude of overall weight transfer towards the target or intended direction, by means including checking the direction and magnitude of the combined force on both feet at relevant instances during the swing, and comparing the values to available reference data. The relevant instances may include the time instant close to the end of the backswing, the time instant associated with transition between the backswing and the downswing, and time instances at intervals through the downswing The computing means further determines and evaluates the magnitudes and timing of the pre-surge force points and peak force points, relative to each other and to the determined magnitudes and timing of corresponding forces at the beginning and end of the downswing, and comparing these to available reference data.

The computing means also determines and evaluates the player's foot-aligned-longitudinal and/or longitudinal balance throughout the swing, across each foot and across the combination of feet, by checking toes and heel forces on each foot, and the relative relationship between them, against relevant criteria across each stage of the swing, and comparing the values to available reference data. The available reference data may include ranges of ratios of toes/heel force values for individual feet and for the combination of both feet, at the address, at the beginning and end of the backswing and the beginning and end of the downswing.

The computing means additionally determines and evaluates lateral balance across the combination of both feet, by checking the lateral position of the combined resultant force relative to the positions of the feet, across each stage of the swing, and comparing the values to available reference data. The available reference data may include ranges of ratios of lateral left/right force values for the left and right feet, at the address, at several points through the backswing and downswing, including the beginnings and ends.

The computing means also determines and evaluates foot-aligned-lateral and/or lateral rolling of the player's left or right feet, by checking foot-aligned-lateral and/or lateral positions of the resultant forces on each foot relative to that foot, across each stage of the swing, and comparing the values to available reference data. The available reference data may include ranges of ratios of foot-aligned-lateral and/or lateral left/right force values for the left and right feet, at the address, at several points through the backswing and downswing, including the beginnings and ends, lateral left/right force values for individual left and right feet, at the address, at the beginning and end of the backswing and the beginning and end of the downswing.

The computing means further determines or estimates the duration between the end of the different components of backswing, and relative delays at the changeover from backswing to downswing, by statistical analysis of the duration and magnitude of least change across a selected range of variables which are known to typically reduce their rate of change at the time of changeover, including foot, toe and heel force positions and magnitudes on both feet, and comparing the values to available reference data. The available reference data may include ranges of absolute values and ratio values.

The computing means additionally determines if the player lifts a foot off the standing surface, by checking if the magnitude of the resultant force reduces to zero or close to a zero value, and comparing the values to available reference data.

The computing means also determines if the player slides a foot to a different position on the standing surface, by checking if the position of the resultant force occurs outside the resultant boundary limits established for the foot position, and comparing the values to available reference data.

The computing means also determines if the player slides a foot to a different position on the standing surface, by checking if the magnitude of the heel component force or the toe component force reduces to zero value or close to a zero value, and comparing the values to available reference data.

The computing means additionally determines and evaluates the relative consistency of different swings by determining differences in their relevant characteristics and comparing the values of these differences to available reference data. The relevant characteristics comprise any measured or determined characteristics which are relevant to required measures of consistency and include any value or characteristic which is compared to available reference data. Differences in relevant characteristics may be expressed as dimensionless entities, such as ratios.

The computing means is arranged such that it may selectively assign lower importance, in accordance with available reference data, to force measurements from a very lightly loaded foot than to those from a relatively heavily loaded foot, when determining or estimating likely times of feature events or player performance based on changes, on individual feet, of toes, heel or resultant forces.

Signals relayed to the computing means are converted to digital format and handled thereafter in digital or numeric format as commonly used in computing means. Known computing and statistical methods may be used to effect the computations and analyses. Detections of changes, maximums, or minimums may include the comparison of successive values of a variable when the variable is sampled at regular time intervals. Determination of reversals may include the detection of a positive to negative, or negative to positive change in successive values of variables when the variables are sampled at regular time intervals. Determination of relative differences between the variables may include calculating the difference when the variables are simultaneously sampled at regular time intervals. Smoothness or regularity may be determined by the relative maximum magnitude of the differences in changes, and the frequency of occurrence of such changes, compared to available reference data. Smoothness or regularity may also be detected by peaks in acceleration of the variable. Available reference data may include ranges of values of particular characteristics, or ranges of absolute values and ratio values, appropriate to circumstances, judged in relation to graded achievement. The computing means may match the player's performance to the relevant standard and associate the corresponding graded achievement.

The invention claimed is:

1. Apparatus for measuring and analyzing a player's foot related forces during a golf swing or a sports swing similar to a golf swing, comprising a standing surface for the player; a communication means; a plurality of sensor means which are operable to measure force;

the standing surface comprising two separate foot platforms for the player's feet, each foot platform comprising a supporting structure including a surface with a plurality of discrete positions to which vertical forces on the supporting structure are distributed;

the communication means for communicating to the player with information related to a performance of the player, thereby allowing the player to understand the performance without assistance from a skilled third party;

the sensor means, located at the discrete positions, for measuring vertical forces;

a computing means for analyzing the swing, including:

means for receiving and separately processing signals from the sensor means; means for determining the relative magnitudes and positions of resultant forces by balance-resolution of forces, including individual forces measured by the sensor means in relation to the discrete positions;

means for analyzing and evaluating numerical data related to the measured positions and magnitudes of the forces; and the computing means for analyzing the swing based on an evaluation of forces from the sensor means against a framework of feature events, determined positions of the feet, and a body of information available to the computing means comprising available reference data;

wherein:

the evaluation related to the framework of feature events is based on a mapping of the times of various detectable principal events which are common to all normal swings;

the evaluation related to the determined positions of the feet is based on a statistical analysis of a batch of resultant forces measured by the sensor means where the player shifts weight with the foot in that position; and the available reference data include at least one piece of:

information related to known swing performance, including criteria which allow different aspects of the performance to be judged against a predetermined performance when the available reference data is prepared;

information accessible by the computing means from a logging means for logging information concerning previous swings made by the player, and the player's previous performance;

and information accessible by the computing means from a co-operating means for co-operating with other apparatus, the co-operating means is for receiving further information on the swing from the other apparatus.

2. An apparatus according to claim 1, wherein the communication means is operable to communicate with the player and the apparatus is operable to be used by the player without assistance from a skilled third party.

3. An apparatus according to claim 1, wherein the computing means comprises software with training elements; the communicating means is for communicating with a player; and the computing means and communication means are for being used with interactive training processes where the results of the analysis are used to prompt a training element within the computing means software.

4. An apparatus according to claim 1, wherein the means for analyzing the swing is based on an evaluation of forces received from the sensor means is against a framework of feature events.

5. An apparatus according to claim 1, wherein means to analyze the swing by evaluating forces from the sensor means is against a framework of determined positions of the feet.

6. An apparatus according to claim 1, wherein the available reference data include information related to known swing performance, including criteria which allow different aspects of the performance to be judged against a predetermined performance when the available reference data is prepared.

7. An apparatus according to claim 1, wherein the apparatus includes a logging means and available reference data include information which is accessible by the computing means from logging means operable to log information concerning previous swings made by the player and information on the player's previous performance.

8. An apparatus according to claim 1, wherein the apparatus includes a co-operating means which is operable to receive further information on the swing from other apparatus or systems, and available reference data include information which is accessible by the computing means from the co-operating means.

9. An apparatus according to claim 1, wherein the sensor means comprises one of the following strain gauge sensors;

each strain gauge sensor comprises two strain gauge elements and a strain member having one surface region which stretches and another surface region which compresses when the sensor is subjected to load with one of the strain gauge elements being connected to each of these regions, so that one stretches and increases in resistance and the other compresses and decreases in resistance, as load is applied to the sensor;

the strain member comprises a beam which is connected at one end to a support member which is cantilevered above the position of the strain gauge elements and is connected at the other end to a support member which is cantilevered below the position of the strain gauge elements, whereby load is applied to the sensor through the support members;

each strain gauge sensor comprises a flexible member whereby load is applied to one of the support members through the flexible member; and the strain gauge elements are electrically connected in a bridge configuration, such as a balanced Wheatstone bridge configuration.

10. An apparatus according to claim 1, wherein the foot platforms are one of a rectangular shape and a square shape and are disposed laterally adjacent each other;

the sensor means are disposed underneath the foot platforms with one sensor means adjacent each corner region of each foot platform; and optionally, the sensor means are horizontally symmetrically arranged, with the centers of all sensor means to the front of the platforms being disposed laterally co-linearly, the centers of all sensor means to the rear of the platforms being disposed laterally co-linearly, and the centre of each sensor means to the front disposed longitudinally co-linearly with the centre of one corresponding sensor means to the rear.

11. An apparatus according to claim 1, wherein each foot platform comprises two sets of connected rigid elements which support the surface of the foot platform and are substantially disposed in a horizontal plane; the first set of connected rigid elements comprises two parallel rigid elements, and the second set comprises a plurality of mutually parallel rigid elements which are disposed at an angle, to the first set, the rigid elements of the second set span, and are supported by, the rigid elements of the first set, which are supported by the sensor means, such that a vertical force applied to the elements of the second set, is transferred to the elements of the first set and then to the sensor means; and the two sets of rigid elements cooperate so that the foot platform is relatively rigid in directions parallel to the rigid elements and relatively flexible in other directions;

the foot platform comprises a polymer molding and the rigid elements comprise integral ribs in the molding; and the foot platform is supported on a base which has less flexibility than the foot platform in directions where the foot platform is relatively more flexible.

12. An apparatus according to claim 1, wherein the computing means is for determining the position of the combined resultant force from the player's feet based on balance-resolution of forces and characteristics of forces determined for the feet in relation to the discrete set positions of the sensor means.

13. An apparatus according to claim 1, wherein each of the foot platforms are sufficiently larger than an anticipated length of the player's foot to allow a choice of foot positions; and the length and width of each foot platform are each between 1.5 and 2.5 times of length and width of the anticipated length of the player's foot.

14. An apparatus according to claim 13, wherein the computing means is for determining a foot position or characteristics of a foot position based on statistical analysis of a batch of resultant forces measured by the sensor means when the player shifts weight within the foot position.

15. An apparatus according to claim 14, wherein the computing means is for instructing the player to shift weight sufficiently to provide a batch of resultant forces with predefined front-to-back and side-to-side diversity.

16. An apparatus according to claim 15, wherein the predefined front-to-back predefined diversity is between 0.45 and 0.55 times of one of the length of the foot and the anticipated length of the foot; and the predefined side-to-side required diversity is between 0.10 and 0.18 times of the length of the player's foot, or the anticipated length of the player's foot.

17. An apparatus according to claim 16, wherein the length of the foot is estimated with reference to a static weight of the player and of the club determined by the sensor means.

18. An apparatus according to claim 14, wherein the foot position is represented by a best-fit line, statistically derived from the batch of resultant forces, and approximately corresponding to a central long axis of the foot; and the statistical derivation of the best-fit line is based on a best-fit line relative to the boundary of the batch of resultant forces.

19. An apparatus according to claim 18, wherein the foot position is represented by a statistical centre, statistically derived from the batch of resultant forces, and approximately corresponding to the position of the resultant force on the foot when the resultant force is centrally balanced on the foot; and the statistical centre is determined as a point lying on the best-fit line, positioned midway between the most forward and most rearward values of the batch of resultant forces.

20. An apparatus according to claim 18, wherein the computing means is for evaluating the position of the resultant foot force relative to two orthogonal axes including a line corresponding to a long central axis of the foot and a line orthogonal to the long central axis passing through a point which corresponds to a centrally balanced position of the foot; and the line and point are a best-fit line and a statistical centre determined from a sample batch of resultant foot forces.

21. An apparatus according to claim 18, wherein the computing means is for determining components of the resultant foot force by balance-resolution of the resultant foot force in relation to one of the determined foot position and characteristics of the foot position.

22. An apparatus according to claim 21, wherein the computing means is for determining components of the resultant foot force, for a given foot position, into component forces resolved as co-linear forces with the resultant foot force, and with a common focus position to the rear of the foot;

the computing means is for determining components as toe and heel components, with their positions co-linear with the resultant force and with a focus point to an rear of the best-fit line, the position of the toe component lying on a toe line, which is a notional and simplified locus of the most forward positions of the resultant fore; and the position of the heel component lying on a heel line, which is a notional and simplified locus of the most rearward positions of the resultant force; and the heel line is a straight line, orthogonal to the best-fit line, positioned to the rear of the statistical centre between 0.30 and 0.40 times of the anticipated length of the player's foot, the toe line is a straight line, at an angle between 45° and 75° to the best-fit line, positioned forward of the statistical centre between 0.30 and 0.40 times of the anticipated length of the player's foot and the focus point lies on the best-fit line, at a distance to the rear of the statistical centre, between 0.65 and 1.00 times of the anticipated length of the player's foot.

23. An apparatus according to claim 14, wherein the batch of resultant forces is provided at the waggle and address preceding the swing.

24. An apparatus according to claim 14, wherein the foot position is represented by at most two entities.

25. An apparatus according to claim 14, wherein the computing means is for evaluating the resultant foot force based on a comparison of one of the longitudinal and lateral positions, with the determined characteristics of the foot position.

26. An apparatus according to claim 1, wherein the apparatus is for measuring and analyzing foot related forces during a golf swing.

27. An apparatus according to claim 26, wherein the computing means is for determining times of occurrence of feature events in a golf swing and is for using the times of occurrence in the analysis of the golf swing.

28. An apparatus according to claim 27, wherein the computing means is for determining the one of the player's foot-aligned-longitudinal and longitudinal, balance throughout the swing, across each foot and across the combination of feet, by checking toe and heel forces on each foot, and the relative relationship between them, against relevant criteria across each stage of the swing, and for comparing the values to available reference data available to the computing means; and the available reference data is pre-programmed and includes ranges of ratios of toes/heel force values for individual feet and for the combination of both feet, at the address, at the beginning and end of the backswing and the beginning and end of the downswing judged in relation to graded achievement and the computing means is for matching the player's performance to the available reference data and for associating the corresponding graded achievement.

29. An apparatus according to claim 27, wherein the computing means is for determining lateral balance across the combination of both feet, by checking the lateral position of the combined resultant force relative to the positions of the feet, across each stage of the swing, and comparing the values to available reference data available to the computing means; and the available reference data is pre-programmed and includes ranges of ratios of lateral left and right force values for the left and right feet, at the address, at several points through the backswing and downswing, including the beginnings and ends judged in relation to graded achievement and whereby the computing means is for matching player's performance to the available reference data and for associating the corresponding graded achievement.

30. An apparatus according to claim 27, wherein the computing means is operable to for determine determining and evaluating foot-aligned-lateral for and lateral rolling of the player's feet, by checking foot-aligned-lateral and lateral positions of the resultant forces on each foot relative to the foot, across each stage of the swing, and comparing the values to available reference data available to the computing means; and the available reference data is pre-programmed and includes ranges of ratios of foot-aligned-lateral or lateral force values for the left and right feet, at the address, at several points through the backswing and downswing, including the beginnings and ends, foot-aligned-lateral or lateral left and right force values for individual left and right feet, at the address, at the beginning and end of the backswing and the beginning and end of the downswing, judged in relation to graded achievement and in which the computing means is for matching the player's performance to the available reference data and for associating the corresponding graded achievement.

31. An apparatus according to claim 27, wherein the computing means is for determining or estimating the duration between the end of pelvis related backswing and the end of club backswing, and relative delays at the changeover from backswing to downswing by based on a statistical analysis of the duration and magnitude of least change across a selected range of variables which are known to typically reduce their rate of change at the time of changeover, including foot, toes and heel force positions and magnitudes on both feet, and comparing the values to available reference data available to the computing means; and the available reference data is pre-programmed and includes ranges of absolute values and ratio values, appropriate to circumstances, judged in relation to graded achievement and wherein the computing means is for matching the player's performance to the available reference data and for associating the corresponding graded achievement.

32. An apparatus according to claim 27, wherein the computing means is for determining if the player lifts a foot off the standing surface, based on a checking of whether the magnitude of the resultant force reduces to zero value or close to a zero value, and a comparing of the values to available reference data available to the computing means; and the available reference data is pre-programmed and includes varying fault grading for the occurrence in the period prior to backswing, the period of backswing and downswing, and the period of follow-through and wherein the computing means is for matching the player's performance to the available reference data and for associating the corresponding graded achievement.

33. An apparatus according to claim 27, wherein the computing means is for determining if the player slides or rotates a foot to a different position on the standing surface, based on a checking of whether the position of the resultant force moves outside the resultant boundary limits established for the foot position, and a comparing of the values to available reference data available to the computing means; and the available reference data is pre-programmed and includes varying fault grading for the occurrence in the period prior to backswing, the period of backswing and downswing, and the period of follow-through, the boundary limits are calculated in a predefined relationship to characteristics defining the position of the foot and wherein the computing means is for matching the player's performance to the available reference data and for associating the corresponding graded achievement.

34. An apparatus according to claim 27, wherein the computing means is for determining if the player rotates a foot on the standing surface, based on a checking of whether the magnitude of the heel component force or the toes component force reduces to zero value or close to a zero value, and based on a comparing of the values to available reference data available to the computing means; and the available reference data is pre-programmed and includes varying fault grading for the occurrence in the period prior to backswing, the period of backswing and downswing, and the period of follow-through and wherein the computing means is for matching the player's performance to the available reference data and for associating the corresponding graded achievement.

35. An apparatus according to claim 27, wherein the computing means is for selectively assigning a lower importance, in accordance with available reference data available to the computing means, to force measurements from a very lightly loaded foot than to those from a relatively heavily loaded foot, when determining or estimating likely times of feature events or player performance based on changes, on individual feet, of toes, heel or resultant forces; and the available reference data is pre-programmed and indicate an assignment of lower importance on a very lightly loaded foot where unusual toes, heel or resultant forces are detected.

36. An apparatus according to claim 27, wherein the computing means is for receiving and processing signals from sensors which measure horizontal forces on the foot platforms.

37. An apparatus according to claim 27, wherein the computing means is for evaluating foot positions by comparing detected particular characteristics of foot positions, to available reference data available to the computing means, the particular characteristics including distance between foot positions, alignment of the combined lateral axis of the feet with the target direction; alignment angles of individual feet and longitudinal and lateral distance of the feet from the ball position; and the available reference data is pre-programmed and includes ranges of values of particular characteristics judged in relation to graded achievement and the computing means is for matching the player's performance to the available reference data and for associating the corresponding graded achievement.

38. An apparatus according to claim 37, wherein the computing means is for determining and evaluating the relative consistency of different swings based on a determination of differences in relevant characteristics between different swings and comparing the values of these differences to available reference data available to the computing means, the relevant characteristics comprising any measured or determined characteristics which are relevant to required measures of consistency and include any value or characteristic which is compared to available reference data available to the computing means; and differences in relevant characteristics are expressed as dimensionless entities, such as ratios, and the available reference data is pre-programmed and includes varying grading for consistency, appropriate to circumstances and wherein the computing means is for matching the player's performance to the available reference data and for associating the corresponding graded achievement.

39. An apparatus according to claim 27, wherein the computing means is for determining the time of transition changeover from backswing to downswing, the computer means is for determining the time of simultaneous maximum relative difference between toe and heel, or front and back, forces on one of the feet; and the computing means is for calculating the difference when the variables are simultaneously sampled at regular time intervals.

40. An apparatus according to claim 39, wherein the computing means is for determining the relative components of the transition from the results of the various indicators; and the determination is aided by available reference data.

41. An apparatus according to claim 39, wherein the computing means is for determining the time of transition from backswing to downswing, and for assessing or averaging the results of at least one of the available indicators of the transition; and the computing means is for assigning a weighting to the results of each indicator and taking a weighted average of the results, the weighting is partly dependent on a pre-assessment of the relative importance of the indicators and is partly dependent on an assessment of the strength of the result from each indicator.

42. An apparatus according to claim 27, wherein the computing means is for identifying particular periods of the golf swing which are analyzed, and is for analyzing the particular period in finer time detail.

43. An apparatus according to claim 27, wherein the computing means has information of typical and probable sequences and times of occurrence of feature events in golf swings, appropriate to varying circumstances, and is for determining the times of occurrence of feature events in the golf swing by association of the feature events with the sample information; and the computing means is for restricting the search for a feature event within time limits within the swing, relative to other feature events, or assigning probabilities to finding feature events at different time periods of the swing.

44. An apparatus according to claim 27, wherein the computing means has record information of details of occurrence of feature events in golf swings previously taken by the player, and is for determining the times of occurrence of feature events in the golf swing by association of the feature events with the record information; and the computing means is for restricting the search for a feature event of the swing, relative to other feature events, and for assigning probabilities to feature events at different time periods of the swing.

45. An apparatus according to claim 27, wherein the computing means is for determining the commencement of club backswing based on a communication with an apparatus configured to determine a time when the club head leaves the address region;

the computing means is for detecting a reinstatement of an electromagnetic beam which is disrupted when the club head is in the address region; and the computer means is for associating the time of commencement of club backswing with a time shortly preceding the reinstatement of the beam.

46. An apparatus according to claim 27, wherein the computing means is for determining the commencement of backswing, and for seeking, within a short period following the end of one of the waggle and address periods, a fluctuation from a period of least change to a period of sustained change across a selected range of variables, including foot, toe and heel force positions and magnitudes on both feet; and detection of change includes the comparison of successive values of the variable when the variable is sampled at regular time intervals.

47. An apparatus according to claim 7, wherein the computing means is for determining the time of transition changeover from backswing to downswing, by determining the time of reversal of one of the longitudinal, lateral movement, foot-aligned longitudinal, or foot-aligned lateral movement of the forces on one of the feet, wherein determination of the reversal includes the detection of a polarity change in successive values of the longitudinal, lateral, foot-aligned longitudinal, or and foot-aligned lateral variables when the variables are sampled at regular time intervals; and the determination of the reversal includes the detection of a polarity change in successive values of the longitudinal and lateral variables when the variables are sampled at regular time intervals.

48. An apparatus according to claim 27, wherein the computing means is for determining the time of transition from backswing to downswing, and for determining a reversal of movement of the positions of one of the lateral component of combined force on both feet, and a change of direction of movement of one of the lateral and longitudinal components of combined force on both feet;

the determination of the reversal includes the detection of a polarity change in successive values of the lateral variables when the variables are sampled at regular time intervals; and the determination of the change in direction includes the detection of an inflective change in the differences between successive values of the longitudinal or lateral variables when the variables are sampled at regular time intervals.

49. An apparatus according to claim 27, wherein the computing means is for determining the time of transition changeover from backswing to downswing, and for detecting a fluctuation from a period of sustained change, to a relatively short period of least change and back to a period of sustained change, across a selected range of variables, including foot, toe and heel force positions and magnitudes on both feet; and the detection of change includes the comparison of successive values of the variable when the variable is sampled at regular time intervals.

50. An apparatus according to claim 27, wherein the computing means is for determining the time of transition from backswing to downswing, and for determining one of the time of minimum value of force on the front foot, and the beginning of a period of minimum force on the front foot; and the determination of the minimum value includes the detection of lowest value when the variable is sampled at regular time intervals.

51. An apparatus according to claim 27, wherein the computing means is for determining the time of transition from backswing to downswing, and for determining the time of a significant change in the rate of change of differences in the magnitudes of the force between the left foot and the right foot; and the determination of the significant change includes the detection of an inflective change in the rate of change of differences between successive values of the force between the left foot and the right foot when the variables are sampled at regular time intervals.

52. An apparatus according to claim 27, wherein the computing means is for determining the time of the transition from backswing to downswing, and for determining the time where recorded cumulative vertical momentum attains zero value; and the computing means is for detecting a zero value in recorded cumulative overall force, relative to the static weight of the player and club at address, at short regular time intervals from the commencement of the swing.

53. An apparatus according to claim 27, wherein the computing means is for determining the times of pre-surge force points in the downswing, and for detecting changes in the magnitudes of forces on one of the combination of both feet, the left foot, and the right foot, which change from one of a minimum value and a period of relatively constant value from the commencement of the downswing; and the computing means is for detecting when the minimum value of the magnitude of force occurs by comparison of successive values when it is sampled at regular time intervals.

54. An apparatus according to claim 27, wherein the computing means is for determining the time of peak force points in the downswing, and for detecting the time when the magnitudes of forces on one of the combination of both feet, the left foot, and the right foot peak to a maximum value; and the computing means is for detecting when the maximum value of the magnitude of force occurs by comparison of successive values when sampled at regular time intervals.

55. An apparatus according to claim 27, wherein the computing means is for determining the time of impact of the club and ball, based on a communication with an apparatus which is configured to determine when the club head returns to the address region, and for detecting the disruption of an electromagnetic beam by the club head in the address region, and based on a communication with a microphone which is configured to detect the sound of impact; and the computing means is for associating the time of impact with a time very shortly following disruption of the beam.

56. An apparatus according to claim 27, wherein the computing means is for determining characteristics comprising durations between feature events in the swing, and relative relationships of durations between feature events in the swing, based on a comparison of these characteristics with available reference data available to the computing means, the characteristics including absolute values of durations of backswing, downswing, total swing, portion of downswing from start to pre-surge point, portion of downswing from pre-surge point to peak point, portion of downswing from peak point to impact, and the ratio of these absolute values to each other; and the available reference data is pre-programmed and includes ranges of absolute values and ratio values judged in relation to graded achievement and the computing means is for matching the player's performance to the available reference data and for associating the corresponding graded achievement.

57. An apparatus according to claim 27, wherein the computing means for determining one of the smoothness and regularity of changes in the position of specified forces over specified periods of the swing, including:

Left foot, and right foot, toe and heel forces during the backswing;

Left foot, and right foot, toe and heel forces during the downswing;

Left foot, and right foot, lateral foot forces during the backswing;

Left foot, and right foot, lateral foot forces during the downswing;

Left foot and right foot forces during the backswing;

Left foot and right foot forces during the downswing;

Combined left and right foot force during the backswing;

Combined left and right foot forces during the downswing; and the detection of change includes the comparison of successive values of the position when the position is sampled at regular time intervals and smoothness or regularity is determined by the relative maximum magnitude of the differences in changes, and the frequency of occurrence of such changes, compared to available reference data available to the computing means, including pre-programmed available reference data and the computing means is for matching the player's performance to available reference data and for associating a corresponding graded achievement.

58. An apparatus according to claim 27, wherein the computing means is for determining the player's pelvis related movement and for determining the degree of transfer of force from the heel to the toes on the left foot and from the toes to the heel on the right foot, in the backswing, and the degree of transfer of force from the toes to the heel on the left foot and from the heel to the toes on the right foot, in the downswing, and for comparing the values to available reference data available to the computing means; and the available reference data is pre-programmed and includes ranges of ratios of toes/heel force values at the beginning and end of the backswing and the beginning and end of the downswing judged in relation to graded achievement and the computing means is for matching the player's performance to the available reference data and for associating the corresponding graded achievement.

59. An apparatus according to claim 27, wherein the computing means is for determining the timing, direction and magnitude of overall weight transfer towards the target or intended direction, for checking the direction and magnitude of the combined force on both feet at relevant instances during the swing, and for comparing the values to available reference data available to the computing means, the relevant instances including the point in time close to the end of the backswing, the point in time associated with transition between the backswing and the downswing, and points in times at intervals through the downswing; and the available reference data is pre-programmed and includes, for the relevant instances, ranges of directions and magnitudes judged in relation to graded achievement and the computing means is for matching the player's performance to the available reference data and for associating the corresponding graded achievement.

60. An apparatus according to claim 27, wherein the computing means is for determining the magnitudes and timing of the pre-surge force points and peak force points, relative to each other and to the determined magnitudes and timing of corresponding forces at the beginning and end of the downswing, and for comparing the magnitudes and timings to available reference data; and the available reference data is pre-programmed and includes ranges of ratios of force magnitude and position values for individual feet and for the combination of both feet, judged in relation to graded achievement and the computing means is for matching the player's performance to the available reference data and for associating the corresponding graded achievement.

* * * * *

UNITED STATES PATENT AND TRADEMARK OFFICE

CERTIFICATE OF CORRECTION

PATENT NO. : 7,946,928 B2
APPLICATION NO. : 11/913297
DATED : May 24, 2011
INVENTOR(S) : Brian Francis Mooney It is certified that error appears in the above-identified patent and that said Letters Patent is hereby corrected as shown below:

On the Cover Page:

Section (22), PCT Filed: "May 8, 2005" should read --May 8, 2006--

In the Claims:

Claim 30, Col. 26, line 14: "the computing means is operable to for determine determining and" should read --the computing means is for determining and--

Signed and Sealed this
Fourth Day of September, 2012

David J. Kappos

David J. Kappos
*Director of the United States Patent and Trademark Office*